US009499370B2

(12) United States Patent
Iturriza Iceta et al.

(10) Patent No.: US 9,499,370 B2
(45) Date of Patent: Nov. 22, 2016

(54) PILING MACHINE FOR FLAT ITEMS

(75) Inventors: Javier Iturriza Iceta, Irura (ES); Andoni Izaguirre Iturbe, Irura (ES); (Continued)

(73) Assignee: MACARBOX, S.L.U. (ES)

( * ) Notice: Subject to any disclaimer, the term of this patent is extended or adjusted under 35 U.S.C. 154(b) by 442 days.

(21) Appl. No.: 13/697,224

(22) PCT Filed: May 12, 2010

(86) PCT No.: PCT/ES2010/070319

§ 371 (c)(1), (2), (4) Date: Nov. 9, 2012

(87) PCT Pub. No.: WO2011/141584

PCT Pub. Date: Nov. 17, 2011

(65) Prior Publication Data

US 2013/0051968 A1 Feb. 28, 2013

(51) Int. Cl.
*B65H 31/30* (2006.01)
*B65H 29/14* (2006.01)
(Continued)

(52) U.S. Cl.
CPC ..... *B65H 29/14* (2013.01); *B65H 31/20* (2013.01); *B65H 31/3027* (2013.01);
(Continued)

(58) Field of Classification Search
CPC ..... B65H 29/06; B65H 31/30; B65H 31/32; B65H 31/20; B65H 31/38; B65H 33/12
(Continued)

(56) References Cited

U.S. PATENT DOCUMENTS 2,228,887 A * 1/1941 Peterson ..... 414/788.9
3,744,649 A * 7/1973 Ward, Jr. ..... 414/788.7
(Continued)

FOREIGN PATENT DOCUMENTS

EP 0006771 A1 1/1980
EP 0270943 A1 6/1988
(Continued)

OTHER PUBLICATIONS

International Search Report; International Application No. PCT/ES2010/070319: International Application Filing Date May 12, 2010; Mail date Feb. 7, 2011.
(Continued)

*Primary Examiner* — Michael McCullough
*Assistant Examiner* — Lynn Schwenning
(74) *Attorney, Agent, or Firm* — Cantor Colburn LLP

(57) ABSTRACT

A stacking machine for stacking flat items including a first stacking table which descends from a position higher than the infeed end to a stacking position, the separation of a constant flow of flat items in consecutive bundles occurring with this movement, and on which table flat items received from an infeed end are subsequently stacked to form bundles, connected to first displacement means which displace it between a stacking position in which the first stacking table receives flat items and an unloading position in which the bundles are transferred to the unloading means; a second stacking table which descends from a position higher than the infeed end to a stacking position, the separation of a constant flow of flat items in consecutive bundles occurring with this movement, and on which table flat items received from the infeed end are subsequently stacked to form bundles, connected to second displacement means which displace it between a stacking position in which the second stacking table receives flat items and an
(Continued)

unloading position in which the bundles are transferred to the unloading means, unloading means for transferring the bundles from the first or second stacking table to a fixed unloading table; coupling means for coupling the unloading means alternatively to the first stacking table or to the second stacking table.

19 Claims, 23 Drawing Sheets

(75) Inventors: Aitor Aizpurua Velez, Irura (ES); Mikel Irulegui Unzalu, Irura (ES); Aitor Urbieta Arakistain, Irura (ES); José Luis Lerena Ruiz, Irura (ES)

(51) Int. Cl.
*B65H 31/20* (2006.01)
*B65H 31/38* (2006.01)
*B65H 33/16* (2006.01)

(52) U.S. Cl.
CPC ..... *B65H 31/3063* (2013.01); *B65H 31/38* (2013.01); *B65H 33/16* (2013.01); *B65H 2403/55* (2013.01); *B65H 2701/173* (2013.01); *B65H 2701/1762* (2013.01); *B65H 2701/1764* (2013.01); *B65H 2701/1766* (2013.01); *B65H 2701/1768* (2013.01)

(58) Field of Classification Search
USPC ..... 414/790.3, 788.1, 788.9, 789.1, 789.7, 414/790.4, 790.9, 792.7, 793.4, 793.8, 414/794.7, 795.7, 798.7; 198/429, 431
See application file for complete search history.

(56) References Cited

U.S. PATENT DOCUMENTS

| | | | | |
|---|---|---|---|---|
| 3,759,402 | A * | 9/1973 | Hitch et al. | 414/790.3 |
| 4,162,016 | A * | 7/1979 | Schmitt | 414/794.3 |
| 4,270,908 | A * | 6/1981 | Lehmacher | 493/204 |
| 4,436,472 | A | 3/1984 | Kunzmann | |
| 4,500,243 | A | 2/1985 | Ward | |
| 4,902,195 | A | 2/1990 | Lucas | |
| 5,014,974 | A | 5/1991 | Jones | |
| 5,160,129 | A * | 11/1992 | Siriporn et al. | 271/178 |
| 5,366,217 | A | 11/1994 | Tokuno | |
| 5,545,001 | A * | 8/1996 | Capdeboscq | 414/790.8 |
| 5,980,196 | A * | 11/1999 | Roth | 414/790.8 |
| 6,497,549 | B2 * | 12/2002 | Brown | 414/790.3 |
| 6,527,501 | B2 * | 3/2003 | Wolf | 414/789 |
| 6,988,721 | B2 * | 1/2006 | Ingelsten | 271/9.13 |
| 7,178,801 | B2 * | 2/2007 | Kokubo et al. | 271/213 |
| 2002/0150462 | A1 * | 10/2002 | Furthmuller | 414/790.6 |
| 2003/0189284 | A1 | 10/2003 | Ingelsten | |
| 2005/0269765 | A1 | 12/2005 | Widmer | |
| 2005/0280203 | A1 * | 12/2005 | Ozcariz Eizaguirre | 271/214 |
| 2009/0236798 | A1 * | 9/2009 | Kimura et al. | 271/221 |

FOREIGN PATENT DOCUMENTS

| | | | |
|---|---|---|---|
| EP | 0529708 | A1 | 3/1993 |
| EP | 0578990 | A1 | 1/1994 |
| EP | 0666234 | A1 | 8/1995 |
| EP | 1518807 | A1 | 3/2005 |
| ES | 2004412 | A6 | 1/1989 |
| WO | 0222482 | A1 | 3/2002 |

OTHER PUBLICATIONS

Extended European Search Report for corresponding application EP10 81 8126; Report dated Feb. 20, 2014.

* cited by examiner

PILING MACHINE FOR FLAT ITEMS

TECHNICAL FIELD OF THE INVENTION

The present invention is comprised in the technical field of machines for manipulating flat items and, particularly, in the sector of stacking machines for stacking flat items such as, for example, aluminum sheets, paper, chipboard, plywood, etc., and is especially useful in the stacking of flat cardboard items, such as cardboard sheets and folded cardboard boxes.

BACKGROUND OF THE INVENTION

These machines for stacking flat items, which are used in many industrial sectors, apart from stacking batches made up of a determined number of such items from a constant and continuous flow thereof, tend to count and extract those batches. Flat items of this type can be aluminum sheets, paper, chipboard, plywood, cardboard etc.

In the industry for transforming and manipulating cardboard and particularly corrugated cardboard, there is a range of so-called "FLEXO-FOLDER-GLUER LINES" machines, known by the abbreviation "FFG LINES", which are used for manufacturing printed and die-cut cardboard sheets, as well as for forming folded, glued and/or stitched boxes from the previous cardboard sheets. Square or rectangular cardboard sheets are introduced in this type of machine and bundles made up of a determined number of boxes (for example from 2 to 30) stacked one on top of the other are obtained at the end of the line. The height of these bundles can vary between limits generally comprised, for example, between 5 and 350 mm. The purpose of this extraction is to form the bundles to send them to a subsequent strapping and packing process, finishing the bundle in a transport pallet.

These lines in which the transformation of the cardboard sheets is carried out comprise different modules, in which different operations are carried out. These modules are basically the following:

INTRODUCER: It is the module responsible for feeding the sheets to the line. It feeds a sheet by advancement of the printing roller which is in the printer module.

PRINTER: It is the module responsible for printing the sheets with ink.

SLOTTER: It is the module responsible for cutting the slots, marking the folding slits and the gluing flap.

CUTTER: It is the module responsible for carrying out all the other irregular cuts which the SLOTTER cannot carry out, when the cardboard sheet optionally requires so.

FOLDER: It is the module responsible for gluing the flap and folding the panels of the box on the previously marked slits, thus forming the box.

STITCHER: It is the module responsible for stitching the flap of the box with staples.

STACKER: It is the module responsible for stacking said sheets or boxes in perfectly counted and arranged bundles.

Conventionally, the manufacturers of these "FFG" LINES use a stacking module at the end of their lines to generally carry out a process which is fairly problematic for all manufacturers today, and the basic operations of which are: receiving, aligning and squaring up the sheets or boxes that come from the folder, because they may be slightly out of square; forming each bundle with the exact number of boxes and separating the last box of a bundle and the first box of the next bundle; this process has to be carried out in a fraction of a second; stacking the boxes in piles or stacks without said boxes coming from the folder being able to open, i.e., preventing the panels of the boxes from being unfolded during the stacking process and jams from occurring in the operation of the stacker; and removing the bundles or stacks of boxes from this module and introducing them into the next, which generally tends to be a strapping machine. It thus proceeds to the strapping of the bundle.

The existing conventional stackers can carry out the stacking in two ways, namely, by the lower part, i.e., the box enters the stack below the box which had previously entered, or by the upper part, in which case the box enters from the top, one on top of the other.

Document EP-A-0666234 describes a station for stacking, separating and evacuating the batches to the discharge end of a machine for transforming cardboard sheets, wherein the station stacks folded and flattened cardboard boxes in the lower area thereof, comprising element intake means, these elements falling on a stack which is formed on a raised table which descends as the stack is created, the upper part of the table being formed by rollers or treadmills, also comprising separator arms joined to a mobile horizontal crossbar which is displaced parallel and perpendicular to the plane of the table, the separators being positioned to receive the plate elements. It also comprises a discharge conveyor, to the level of which the table descends for evacuating the batch or elements bundle.

Document EP-A-0006771 describes a process and a device for stacking sheets, based on a system of conveyor belts which displace the cardboard boxes and deposit them in a stack with height-adjustable base, such that that when a determined height is reached, the stacker interrupts the loading of boxes to the stack.

Document EP-A-0578990 in turn describes a sheet retaining member for storing the stack, this retaining member being formed based on elastic bars, displaceable by pistons or cylinders, to retain the sheets of cardboard boxes when these are stacked.

Document EP-A-0529708 describes a machine having means for displacing each sheet to the infeed end through the infeed end on the upper area, having rotating elastic cams by means of which compacting and flattening of the folded boxes is carried out, introducing them into the inside until reaching a stop. In this machine, and after the operations previously mentioned, the folded boxes are then lowered to a stacking area and, when the stack is of a determined height, the entire assembly or bundle is displaced due to the action of rollers.

The Spanish patents with numbers ES-512711, ES-523290, ES-523291 and ES-523.292, which correspond to the U.S. Pat. No. 4,500,243, describe improvements in machines or apparatus for feeding successively synchronized sheets, based on a corrugated cardboard sheet feeder, synchronized with other adjacent machines, using negative atmospheric pressure to fasten each sheet against the transporting means made up of conveyors, all without the need for valves and without interrupting the suction pressure. Likewise, a mechanism for feeding, with stopping and omission, which allows the feeding of sheets in alternate cycles and by selective stopping is described in these Spanish patents.

On the other hand, U.S. Pat. No. 5,980,196 describes a box counter-ejector which feeds a machine in which means for stacking the folded cardboard boxes are established. These means have pressure elements which keep the box folded during the displacement thereof along the conveyor belts, from the infeed end area to the stacking area. Fingers which are always introduced at a determined height between the boxes are also described in the United States patent, dividing the stack bundle so that the bundle has a height selected by the lower area itself of the fingers at the discharge end of the machine such that the stacked boxes arranged on these fingers form what will be the following bundle.

The staking machines must carry out the stacking and counting of the flat items and separating and extracting the corresponding batches of flat items in a greatly reduced time lapse, and at the same time they must avoid mistakes in counting, jams and flaws in the flat items; therefore its good operation is critical in the production lines of flat items because in the event of any failure such as a jam, for example, the entire production line is paralyzed. However, the stacking machines of the state of the art can still be improved with regard to the combination of a suitably fast work speed and a very high operational safety.

BRIEF SUMMARY

The present invention aims to overcome the drawbacks of the state of the art detailed above by means of a machine for stacking flat items comprising an infeed end for flat items and a discharge end for bundles of flat items; and stacking means in which flat items successively received from the infeed end are stacked to form successive bundles of flat items which is characterized in that it further comprises a first horizontal stacking table and a second horizontal stacking table arranged in respective longitudinal planes vertically parallel to one another;

first displacement means susceptible to displacing the first stacking table in a longitudinal plane and in a vertical plane at least between a horizontal stacking position in which the first stacking table receives flat items to successively form first bundles and an unloading position in which the bundles are successively transferred from the first stacking table to unloading means;

second displacement means susceptible to displacing the second table in said longitudinal plane and in said vertical plane at least between said stacking position in which the second stacking table receives flat items to successively form bundles when the first stacking table is not in said stacking position, and said unloading position in which the bundles are successively transferred from the second stacking table to said unloading means when the first stacking table is in said unloading position;

unloading means to successively collect the bundles of the first stacking table and of the second stacking table; and coupling means which couple the unloading means alternatively to one of the stacking tables when it is finished forming the stack and must unload the bundle and which uncouples the unloading means when the stacking table returns to the standby area and the other table needs the unloading means.

According to the invention, the infeed end can comprise a transversely rotating upper infeed roller and lower infeed roller, between which the flat items enter with pressure applied on their upper face by the upper infeed roller and on their lower face by the lower infeed roller. At least one of the infeed rollers, preferably both, is connected to a drive motor. Preferably, the upper infeed roller is height-adjustable to distance itself from or move closer to the lower infeed roller depending on the thickness of the flat items which enter between the infeed rollers and on the pressure to be applied by the infeed rollers on the faces of the flat items. To adjust its height, the upper infeed roller can be connected to a thickness adjustment cam which adjusts the height of the upper infeed roller. The movements of the thickness adjustment cam are controlled and driven by a control motor.

In the stacking area a swinging infeed beater can be provided which squares up the flat items that are going to be stacked, mounted on an eccentric shaft and a front stop, transversally arranged and between which the stack of flat items is formed, in which case the lower infeed roller, the upper infeed roller and the eccentric shaft are connected to the drive motor by means of an infeed transmission belt.

The front stop can in turn be mounted in a transverse frame longitudinally moveable on adjustment screws driven by a drive motor for adjusting the distance of the front stop with respect to the infeed beater.

An auxiliary frame can also be arranged in the stacking area, in which rotating infeed pressure wheels which apply pressure on the upper faces of the successive flat items deposited on top of the stack of flat items are mounted. Preferably, these rotating infeed pressure wheels are adjustable with regard to the pressure which they exert on the upper faces of the flat items. By means of the rotating infeed pressure wheels a determined and controlled pressure can be applied on the flat items at the time of their falling onto the stacks which will be formed on the respective tables, thus preventing in the case of folded boxes the unfolding of the parts thereof and favoring, in the case of previously glued cardboard boxes, the gluing thereof.

In a preferred embodiment of the invention, the displacement means of each table comprise vertical displacement means for rapidly lowering the stacking table, with which they are associated from a standby position located above the stacking table to the stacking position, for continually lowering the stacking table in the stacking position from an initial stacking position proportionally to the growth of the stack caused by each new flat item deposited on the stack to a final stacking position, and to raise the stacking table from a longitudinally advanced position located below the unloading position. Likewise, the first vertical displacement means comprise longitudinal displacement means for horizontally advancing the stacking table from the final stacking position towards the advanced position located below said unloading position and to move the stacking table back from the unloading position towards the standby position, which is longitudinally equal or approximate to that of the stack.

In this preferred embodiment, the unloading means comprise a mobile unloading table longitudinally guided by respective side guiding elements and displaceable between an extended position towards the infeed end and a retracted position to the discharge end of the machine, such that the coupling means couple the mobile unloading table to one of the stacking tables when the already formed bundle is in the unloading area, and the extraction is necessary, and decouples when the extraction has completed, the stacking table is already in the standby area and the other stacking table claims the unloading means to start the unloading of the already completed bundle. To enable a maximum retraction of the mobile unloading table, this can comprise longitudinal arms which can be inserted into longitudinal cavities corresponding to a fixed evacuation table when the mobile unloading table is displaced to its retracted position.

According to the invention, the respective displacement means of the stacking tables can comprise a longitudinal displacement carriage displaceable along the horizontal guiding means due to the action of a longitudinal displacement screw connected to a longitudinal displacement motor, while the second displacement means can comprise a longitudinal displacement carriage displaceable along the horizontal guiding means due to the action of a longitudinal displacement screw connected to a longitudinal displacement motor. In this case, the vertical displacement means can be arranged in the horizontal displacement carriage and comprise vertical guiding means which guide the stacking table to which they are connected, and a vertical displacement screw driven by a screw motor coupled to the stacking table to displace it vertically. The vertical guiding means can further comprise a first vertical guide and a second vertical guide between which the vertical displacement screw is arranged.

The first stacking table can comprise a plurality of longitudinal, horizontal arms in which respective rows of retractable pressure wheels are arranged which are retracted in the longitudinal arms when the stacking table is in said standby position and emerging in the lower portion of the longitudinal arms when the stacking table reaches its initial stacking position on top of the other stacking table which is in said final stacking position. In this situation, the emerging retractable wheels exert pressure on the stack of flat items which is on the other stacking table, and further facilitate the orderly extraction of the bundles of flat items formed from the stacking area.

For the transfer of the bundles of flat items formed in the respective stacking tables to the mobile unloading table, the stacking machine can be provided with a transverse vertical unloading stop and with a retractable unloading stop. The unloading stop is provided such that, when one of the stacking tables has risen to its unloading position, and upon starting the horizontal trajectory towards the standby area, the bundle contacts said vertical unloading stop, the stacking table being slid entirely below the bundle and the latter being arranged on the unloading table, which is coupled by means of the coupling means to the stacking table. On the other hand, the retractable unloading stop is arranged in the rear part of the mobile unloading table, and retracts when, upon moving towards its extended position, the mobile unloading table slides below the bundle retained by the vertical unloading stop, and which emerges upwards from the mobile unloading table when the latter returns to its retracted position, such that it drags the bundle towards the fixed unloading table.

The fixed evacuation table can be provided with a plurality of longitudinal rows of idler wheels on which the bundles can roll towards the discharge end of the stacking machine. Likewise, the fixed evacuation table can be provided with a central longitudinal unloading belt which passes along the upper surface of the fixed evacuation table and which is connected to driving means, for transporting bundles received from the mobile unloading table towards the discharge end of the stacking machine. This unloading belt can be arranged around a longitudinal row of rotating rollers. In this case, the driving means of the unloading belt are connected in the lower portion to the front part of the mobile unloading table and comprise a driving pin displaceable by a pneumatic driving cylinder between a retracted position in which it does not contact the lower part of the unloading belt and a raised position in which it contacts said lower part and pulls it towards the infeed of the stacking machine when the mobile unloading table is displaced in that direction. The upper part of the unloading belt thus transports the bundles received towards the discharge end of the stacking machine.

In an advantageous embodiment of the invention, the stacking machine further comprises a discharge presser which extends longitudinally on top of the mobile unloading table from the unloading stop towards the table on top of the fixed unloading table. The discharge presser is height-adjustable to exert pressure on at least the bundles which are located on the mobile unloading table.

The stacking machine according to the present invention is preferably provided with conventional sensors and detectors therein, such as position sensors and end of line detectors, connected to a programmable control unit, with parameters such as the dimensions of the flat items, number of flat items per bundle, and determination of the type of flat item that is stacked, such as for example if folded and/or stitched up boxes or sheets of cardboard, etc. are stacked, such that from these parameters the stacking machine carries out the automatic adjustment movements. To be able to achieve these automatic positions, the stacking machine is conveniently controlled by intelligent regulators or controllers which receive the different position references from a central controller.

According to that inferred by the previous description, the two stacking tables alternately perform both the function of stacking the flat items as well as the function of separating the already formed bundles from the stack being formed and can even act as a pulling element for the mobile unloading table in the stacking machine according to the present invention. Likewise, the stacking tables can be positioned in infinite number of positions in the longitudinal plane and in the vertical plane, such that the machine can receive the flat items in any position it determines.

Even though the stacking machine according to the present invention has a special use in the preparation of bundles of flat cardboard boxes and folded cardboard boxes previously stitched up and/or glued, especially in the paper, grey board and corrugated cardboard industries, the use of this invention for other sheets with similar features but of different shapes, weight, density, etc. which sheets are not from specific cardboard and which can be stacked for convenience, in this manner described, such as, for example, aluminum sheets, sheets of paper, sheets of chipboard, etc., cannot be dismissed.

According to the above, the present invention advantageously achieves its objective by means of a stacking machine which allows forming bundles of flat items in a fast, reliable and precise manner, while being simple.

BRIEF DESCRIPTION OF THE DRAWINGS

The following describes aspects and embodiments of the invention based on schematic drawings, wherein.

Figure 1:
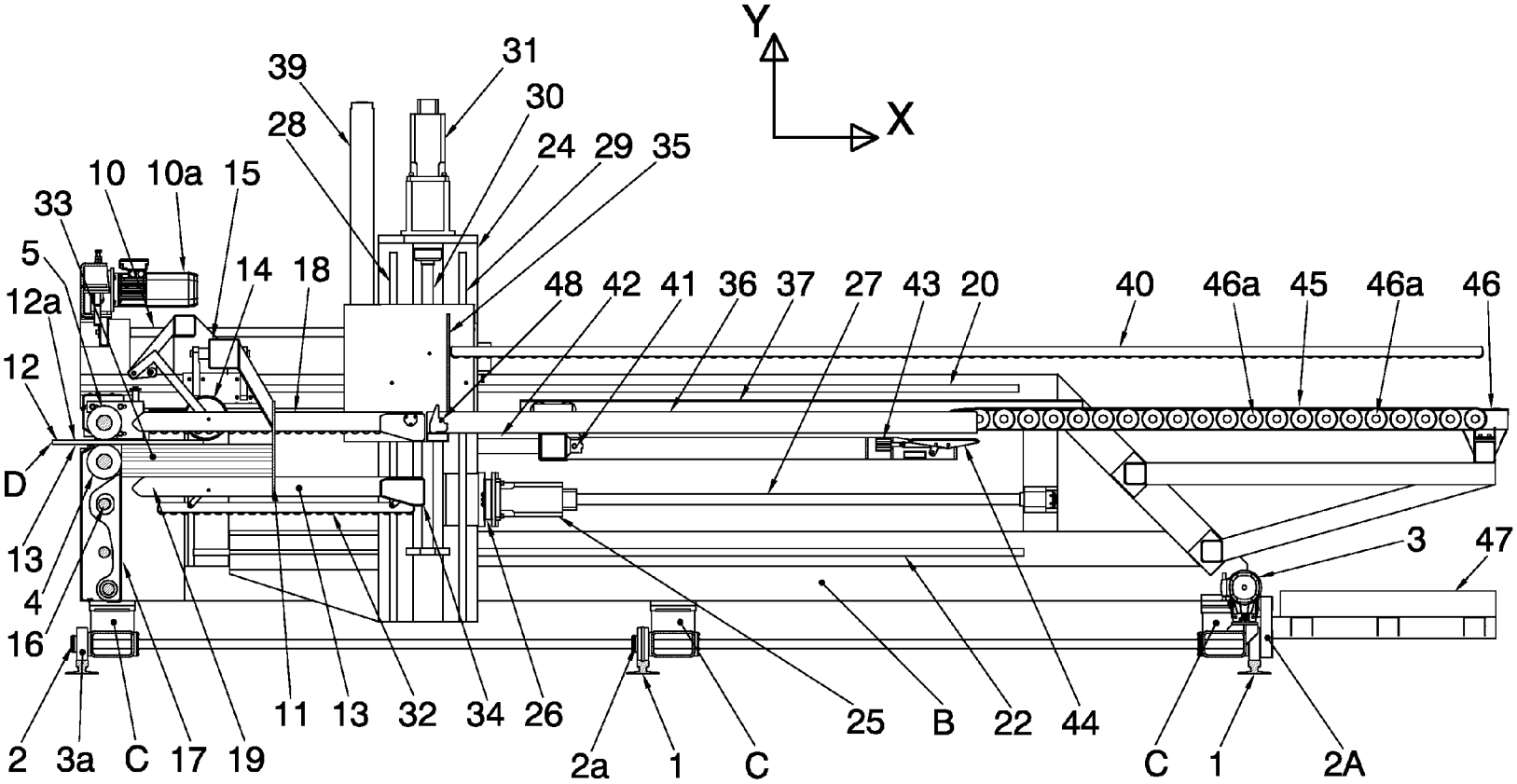
FIG. 1 is a longitudinal section view showing the left half of an embodiment of a stacking machine according to the present invention.
Figure 2:
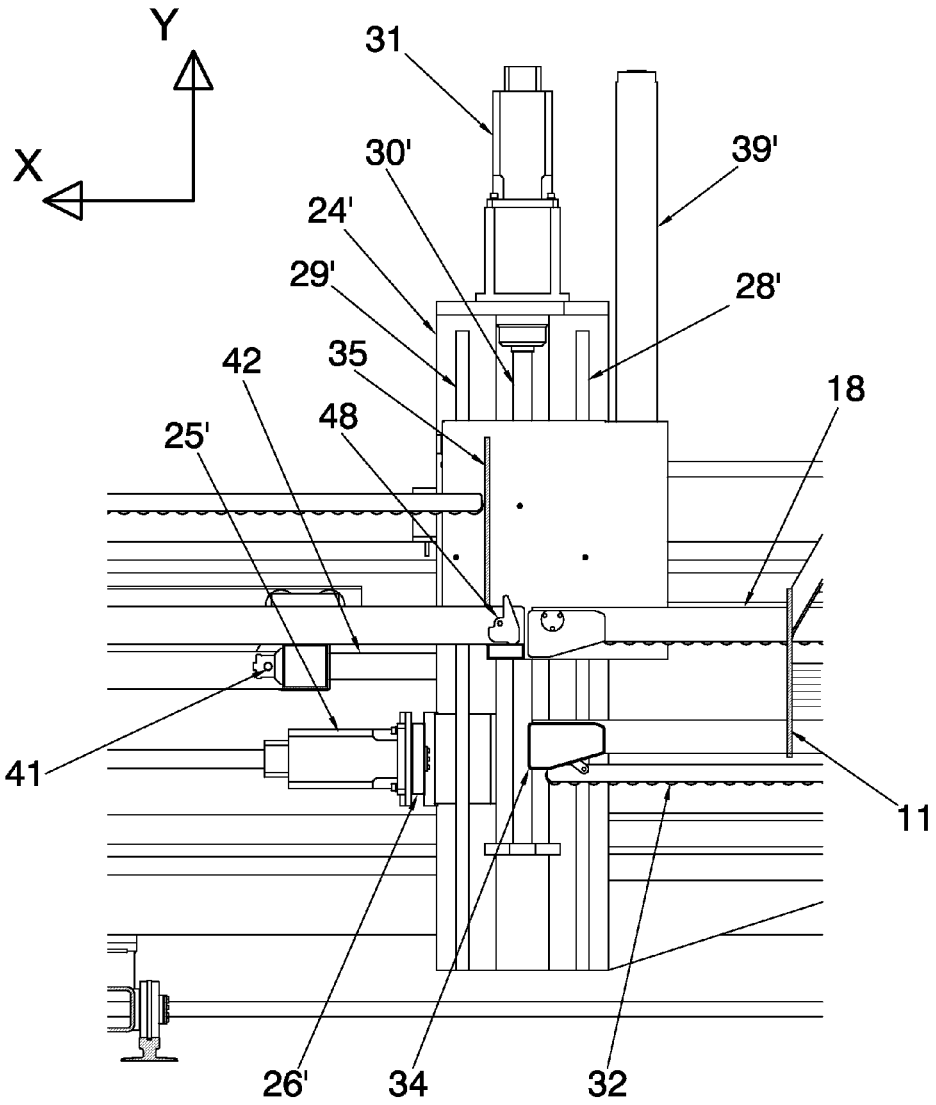
FIG. 2 is a longitudinal section view showing a part of the right half of the machine in FIG. 1.
Figure 3:
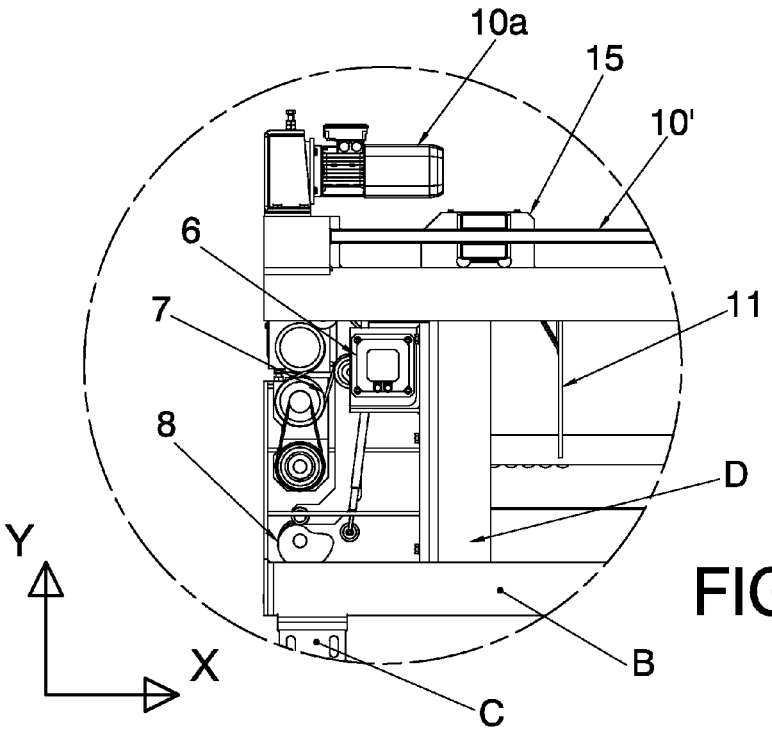
FIG. 3 is a partial view of the right side of the infeed end of the machine shown in FIG. 1.
Figure 4:
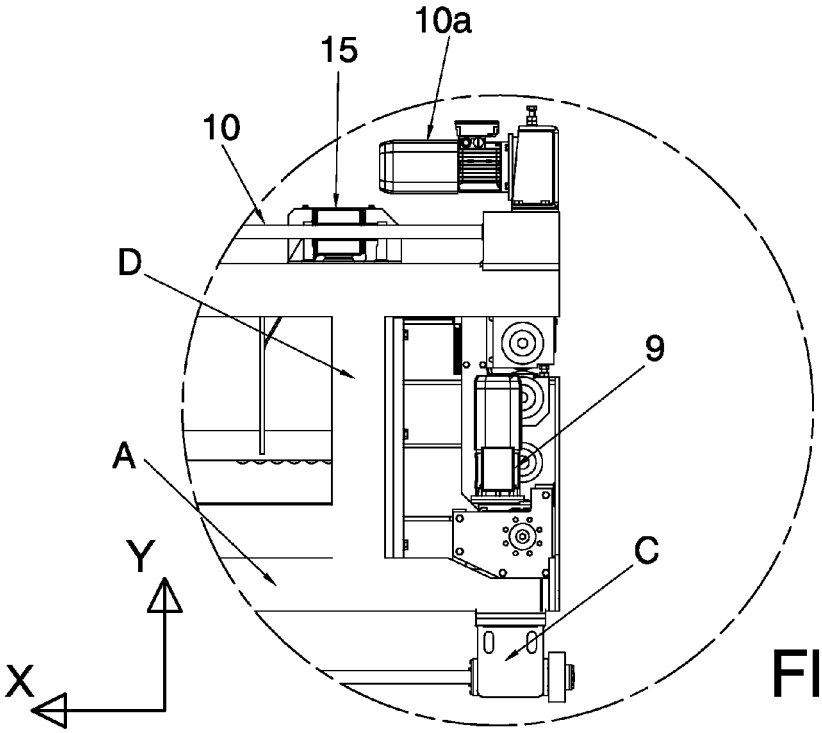
FIG. 4 is a partial view of the left side of the infeed end of the machine shown in FIG. 1.
Figure 5:
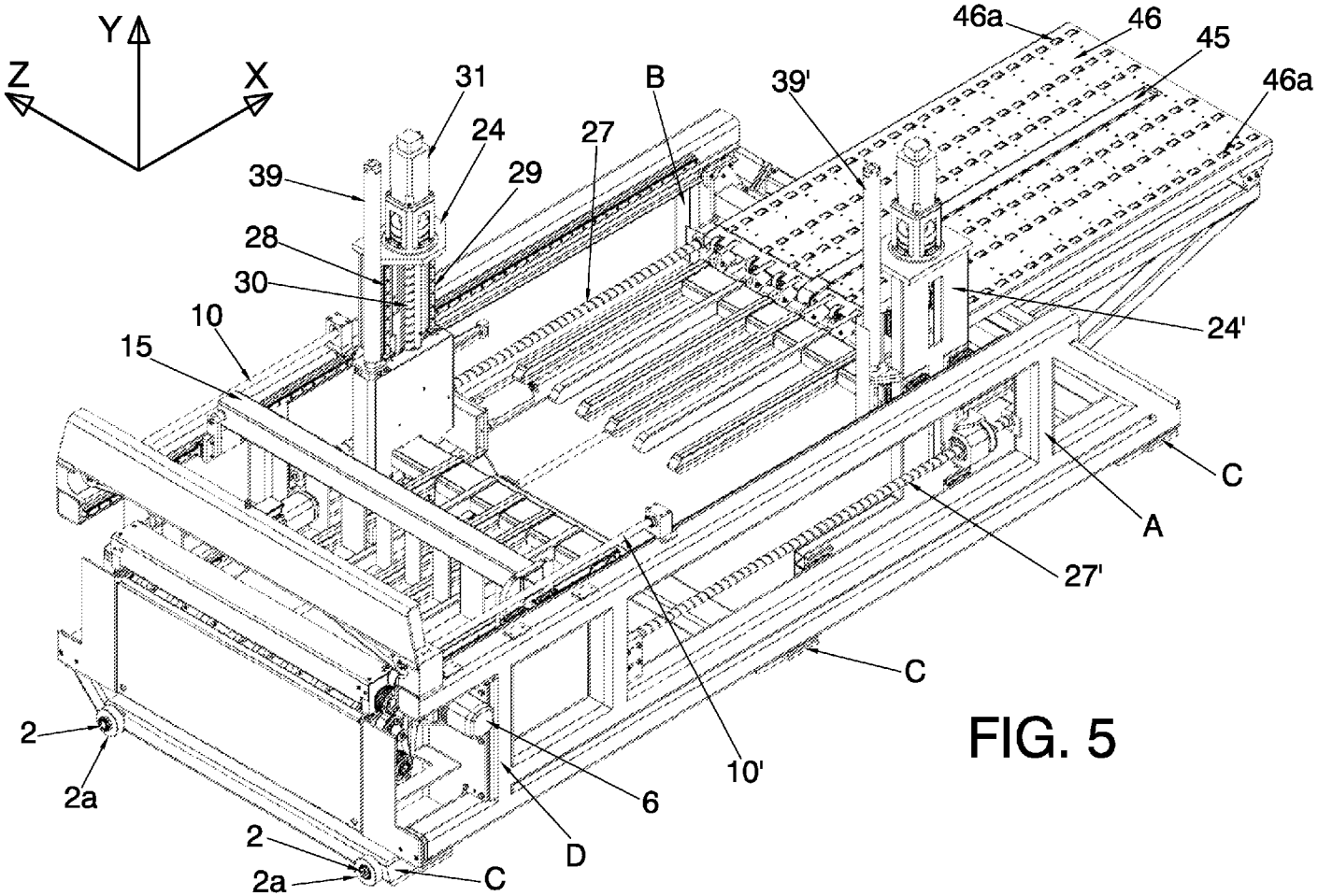
FIG. 5 is a perspective view of the machine shown in FIGS. 1 to 4 as viewed from the right side.
Figure 6:
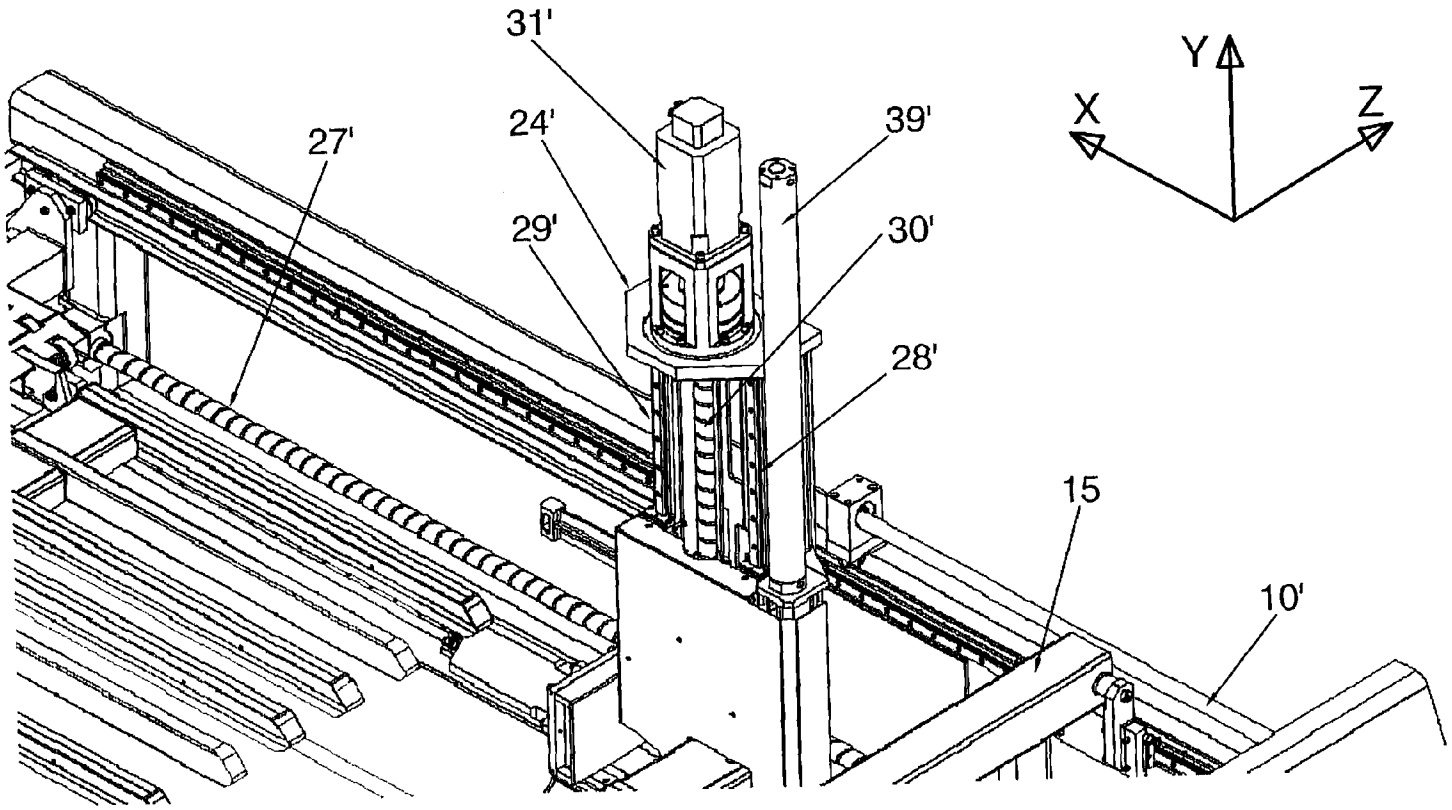
FIG. 6 is a perspective view of part of the machine shown in FIGS. 1 to 5 as viewed from the left side.

Reference numbers appear in these figures which identify the following elements:

1 transverse displacement lane
2 transverse displacement transmission shaft
2*a* transverse displacement wheels
3 transverse displacement motor
4 lower infeed roller
5 upper infeed roller
6 motor for moving infeed shafts and beater
7 infeed shaft transmission belt
8 thickness adjustment cam of the infeed shafts
9 motor for adjusting infeed shafts thickness
10 front stop adjustment screw
11 front stop
12 box which enters the stacker
12*a* upper face of the box which enters the stacker
13 lower face of the box which enters the stacker
14 infeed pressure wheel
15 frame of the front stop
16 eccentric shaft of the beater
17 beater
18 first stacking/separating table
19 second stacking/separating table
20 left longitudinal upper linear displacement guide
21 right longitudinal upper linear displacement guide
22 left longitudinal lower linear displacement guide
23 right longitudinal lower linear displacement guide
24 left longitudinal displacement carriage
24' right longitudinal displacement carriage
25 left longitudinal displacement screw motor
25' right longitudinal displacement screw motor
26 left longitudinal screw transmission belt
26' right longitudinal screw transmission belt
27 left longitudinal displacement screw
27' right longitudinal displacement screw
28 first left vertical linear displacement guide
28' first right vertical linear displacement guide
29 second left vertical linear displacement guide
29' second right vertical linear displacement guide
30 left vertical displacement screw
30' right vertical displacement screw
31 left vertical displacement screw motor
31' right vertical displacement screw motor
32 retractable pressure wheels
33 stack of boxes
33A first bundle of boxes
33B second bundle of boxes
33C third bundle of boxes
33D fourth bundle of boxes
34 discharge part of the stacking table
35 unloading stop
36 mobile unloading table
37 left mobile table guide
38 right mobile table guide
39 left compensation pneumatic cylinder
39' right compensation pneumatic cylinder
40 discharge presser
41 mobile table locking cylinder—longitudinal displacement carriage
42 mobile table locking arm—longitudinal displacement carriage
43 pneumatic driving cylinder of the unloading belt
44 driving pin of the bundle unloading belt
45 central bundle unloading belt
46 fixed evacuation table
46*a* idler wheels
46*b* rotating rollers
47 inspection platform for the operator
48 retractable unloading stop
A, B longitudinal frames
C crossbars
D infeed frame
X longitudinal plane
Y vertical plane
Z transverse plane

DETAILED DESCRIPTION

According to the embodiment shown in the drawings, the machine is formed by mechanical-welded elements, which is essentially made up of two symmetric longitudinal frames -A, B- which are mounted facing each other, joined to one another by three crossbars -C-, and joined to the other infeed frame -D- and on which all the elements which will be described below are mounted. These frames -A, B, C, D- are themselves conventional in electromechanical construction.

The machine is supported on side displacement lanes -1- transverse to the longitudinal plane -X- thereof, so that the center of the stacking machine can be placed in the center of the folded box or cardboard sheet -12- to be stacked (hereinafter known as "box -12-"). This center is defined by the previous module to the stacking machine within the transformation line. To that end, a transverse displacement transmission shaft -2- is mounted which communicates the sets of wheels -2*a*- which are mounted respectively in the ends of the three crossbars -C- which join the two longitudinal frames -A, B-. This shaft -2- is driven with a transverse displacement motor -3- such that the shaft -2- rotates the wheels -2*a*- and thus obtains the movement of centering the stacker in the transverse plane -Z-.

The height at which the box -12- enters this stacking machine is defined as level "0". When the box -12- arrives from the transformer module which precedes the stacking machine, it meets an upper infeed roller -5- and a lower infeed roller -4-. The box -12- passes between these rollers -4, 5- which are motorized and synchronized by means of a drive motor -6-. This motor -6- also moves a swinging beater -17-, the function of which is squaring up the boxes -12- as they are incorporated into the stack of boxes -33-. The infeed rollers -4, 5- have the same roller diameter and the upper roller -5- is further susceptible to adopting different positions in the longitudinal plane -X- to better control and direct the box -12- towards the stack -33-. To synchronize these two rollers -4, 5- and the beater -17-, a transmission belt is used -7-, the location of which corresponds to the strict engineering calculations which allow an exhaustive control of the box -12- at the time of stacking. The beater -17- swings on an eccentric axis -16- mounted for that and, as like the rest of the elements which are related through the belt -7-, synchronizes its speed whereby the box -12- coming from the module preceding the stacking machine is carried.

The belt -7- has a predetermined layout in the longitudinal plane -X- and in the vertical plane -Y-, to enable the opening or closing of the upper roller -5- according to the thickness of the box -12-. To control this thickness automatically, a thickness adjustment cam -8- is used the movement of which is automatically controlled and driven by a control motor -9-. If there is a jam in this area, for example, the cam -8- opens quickly and the upper infeed roller -5- can distance itself vertically, for example by 60 mm, then returning to its programmed work position.

The infeed rollers -4, 5- control the pressure on the upper face -12*a*- of the box -12- and also on the lower face -13- thereof. The possibilities of pressure and direction that they give to the boxes -12- are very important for good operation. It must be taken into account that before passing the box -12- through the infeed rollers -4- and -5- all the elements that take part at the time of receiving the boxes which they will then stack the successive stacks -33- must also be laid out in their position.

There is a mobile front stop -11- which is mounted on a frame -15- and which frame is adjusted automatically according to the specifications of the box -12-. These specifications or parameters of the box -12- are given in the central program of the machine, stored in a conventional programmable CPU (not shown in the drawings). The front stop -11- is moved on adjustment screws -10- by means of an independent motor. Between the front stop -11- and the alternative hit of the beater -17- the squaring up of the stack of boxes -33- is achieved.

For total control during the process of receiving the boxes -12- the disorientation of the boxes -12- must be prevented. To that end, the invention also incorporates infeed pressure wheels -14- which also are mounted on their own independent transverse frame and are controlled at the discretion of the machine operator. According to the needs, the wheels -14- can be moved longitudinally at any time of the process of stacking the boxes -12- since the movement thereof is manually driven. The wheels -14- prevent the unfolding of the folded box -12- deposited each time on the stack -33- and they maintain the box in a good layout. The mechanical pressure which is applied on the upper face -12*a*- of each box -12- without damaging it is continuous and non-stop. This action also works with the gluing of the flaps on the box -12-.

The receiving and, consequently, the collection of boxes -12- in the stacks of boxes -33- are carried out alternately on a first or a second stacking table -18, 19-, which are symmetrically identical, and move in a longitudinal plane -X- and in a vertical plane -Y-, respectively mounted in a right longitudinal displacement carriage -24'- and a left longitudinal displacement carriage -24-, and are also respectively slide vertically in the respective carriage -24, 24'-. These movements are driven by servomotors and are carried out on high performance linear guides.

The stacking table -18, 19- is configured to collect the boxes -12-, to make a bundle with the programmed number of boxes -12- and to take the bundle towards the unloading point of the machine. This is what alternately and simultaneously separates, when appropriate, the stacks of boxes -33- are alternately and simultaneously separated. The position for collecting the boxes -12- is automatically adjusted such that the distance between the pressure wheels 14 and the top part of the stack in formation is slightly greater than the thickness of the cardboard sheet -12-.

Each stacking table -18, 19- has rows of retractable pressure wheels -32- inside it, the function of which is, when separation has finished, to apply pressure on the bundle which is below the other stacking table -19-. These pressure wheels -32- can adopt two positions and, at the time of separation of the bundle, tend to be retracted to reduce the thickness of the stacking table -18, 19- to the minimum. The retractable wheels -32- change their position when the stacking table -18, 19- surpasses level zero -0- for receiving the boxes -12- upwards or downwards. This parameter is very important when minimizing the time necessary to carry out the basic process of separating the stacks of boxes -33-. Once the zero point for receiving the boxes -12- is surpassed, the pressure wheels -32- act firmly, preventing the unfolding of the boxes -12-.

For its movement in the vertical plane -Y-, the carriage -24,24'- of each stacking table -18, 19- is guided by guiding lines -28, 29-28',29'-, and the movement is provided by a motor -31, 31'- which drives a screw -30, 30'-. To aid the displacement of the stacking tables, they are provided with respective compensation pneumatic cylinders -39, 39'-. On the other hand, for movement in the horizontal plane -X-, each carriage -24, 24'- uses a controlled servomotor -25, 25'- which, by means of a screw 30, 30', moves the carriage -24, 24'- horizontally on linear guides -20, 22-. These guides -20, 22-21, 23- are located in the left side main frame -B-. The alternative combination of these two stacking tables -18, 19- and separation of stacks -33- is thus according to the combination that one of the tables -18, 19- is stacking the boxes -12- and the other is clearing the stacks -33- at all times.

The machine is also provided with a mobile unloading table -36-, which is always alternately fastened to one of the two carriages -24, 24'- by means of a locking arm -42- driven by a locking cylinder -41-. The mobile table -36- thus always moves with one of the displacement carriages -24- sliding on symmetrical rolling supports which both main frames mounted thereon. The condition as to which carriage the mobile table -36- should be subjected is determined by the stacking table -18, 19- being stacked in each instant. Thus, if the first stacking table -18- is the one being stacked, the mobile table -36- will be fastened to the carriage of the other stacking table, so that the other stacking table drags the mobile table towards the unloading area; it transfers the bundle to the unloading table aided by the vertical unloading stop -35-, which is located in the XY plane, and again drags the mobile table to the standby position so that it can couple to the stacking table carrying out the stacking when the bundling is finished. In summary, the mobile table must be coupled to each of the stacking tables during the unloading of the bundle. The mobile table -36- is also provided with a retractable unloading stop -48- which has the function of not allowing the stack -33- to return backwards.

In order to prevent the stacks of boxes -33- from unfolding, the machine incorporates a discharge presser -40- which is mounted in the entire upper part of the machine, which remains free and aims to maintain the bundle in a compact condition during the discharge thereof, thus facilitating the gluing process of the boxes which has yet to be completed due to lack of time in the preceding modules. The discharge presser -40- is also height-adjustable. The idea is to maintain the bundle under the influence of the discharge presser -40- for the maximum time possible. To that end, the previously made bundle or bundles are cleared from this system just when a space is required for the following bundles.

When, through this mobile table -36-, the bundles circulate towards the discharge end of the machine and, depending on the size thereof, they leave the mobile table -36-; they move to a counter that is mounted on a fixed evacuation table -46- having idler wheels -46*a*-. The bundles leave the stacking machine though the fixed table -46-. In this fixed table -46-, the bundles slide on the idler wheels -46*a*- by effect of the push between some bundles against other bundles. Additionally, a central unloading belt -45- is mounted in the fixed table -46- with automatic driving to enable an automatic unloading of any bundle which, for example, is desired to be checked. So that the operator can carry this out without risk, an inspection platform -47- is mounted, fastened to the left longitudinal frame -B- so that the operator can safely gain access to the bundle. Only in this point can the bundle be touched with the machine running because in the rest of the cycle it would be very dangerous to do so due to such fast automatic movements and the configuration of the machine does not allow it. Other accesses from the main frame will be mounted, but to be able to gain access inside the machine, the machine will automatically and mandatorily be stopped.

As has been indicated, the fixed table -46- comprises a belt -45- moved by a pneumatic cylinder -43- which acts on a driving pin -44- which is stuck to the belt. This pin -44- makes the belt -45- rotate by friction when the mobile table -36- moves as said pin -44- is mounted therein. The movement of the mobile evacuation table -36- mandatorily depends on one of the left -24- or right -24' horizontal displacement carriages.

The movements previously described depend on a central intelligent control which will previously have to be programmed for its operation and which is mounted in the machine with a powerful electric cabinet, touch screen and a suitable protective fairing. The parameters which the operator has to enter in the control are easy to handle and are standard for any manufacturer of folded cardboard boxes or cardboard sheets.

Figure 19:
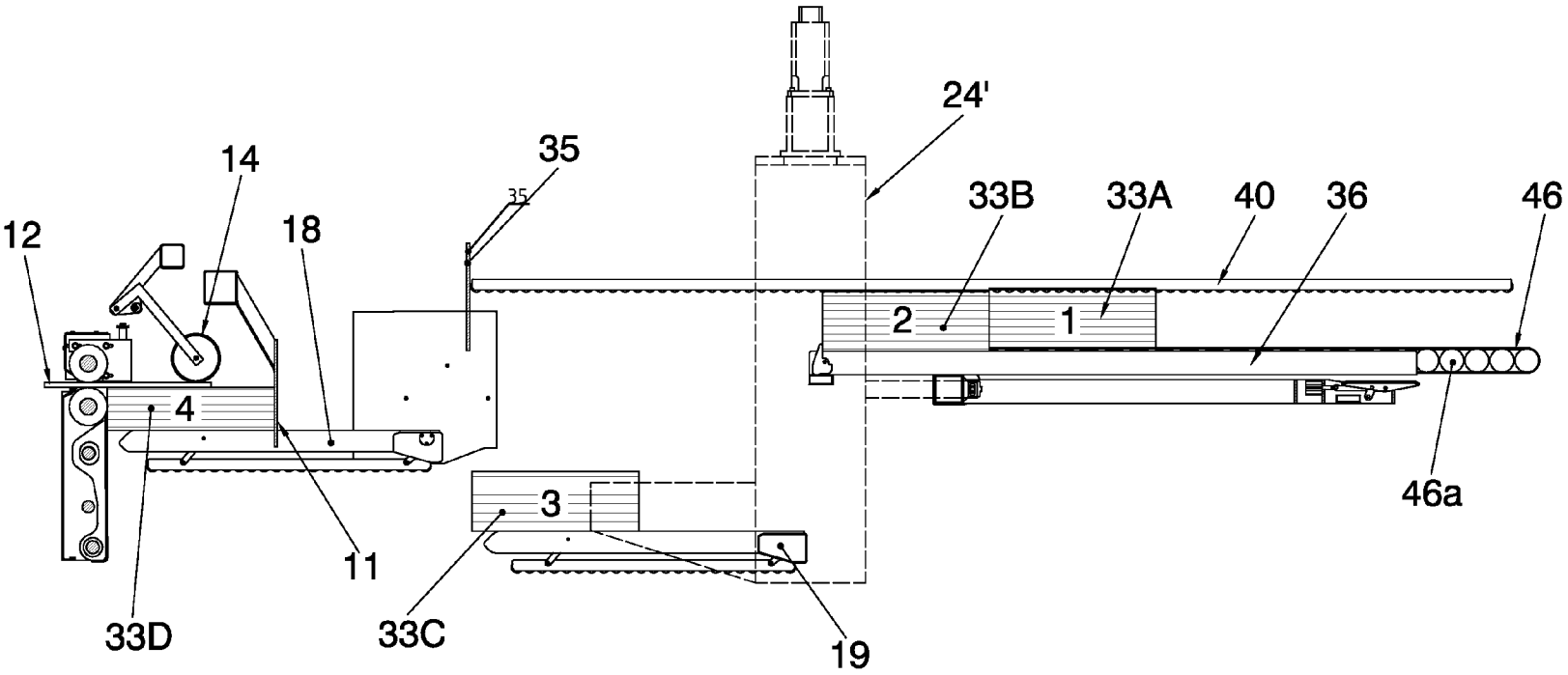
Figure 20:
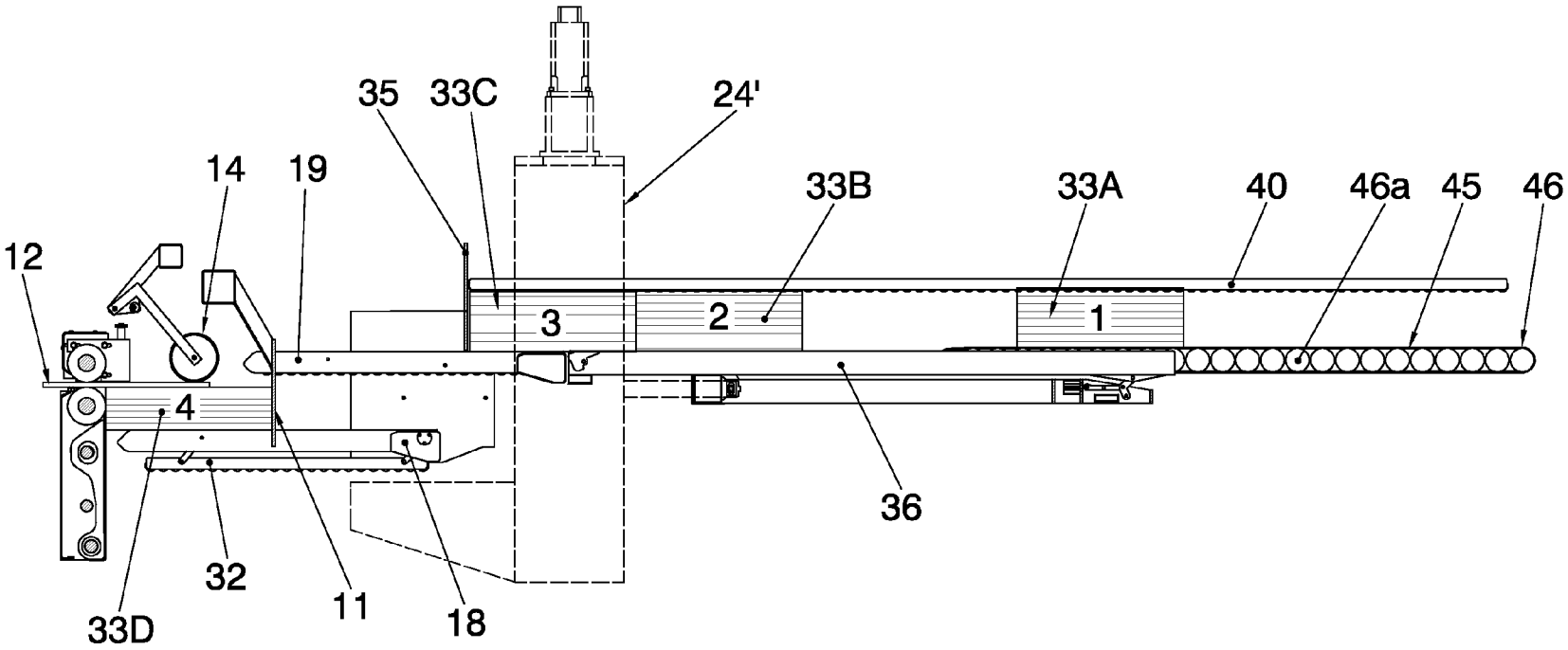
Figure 21:
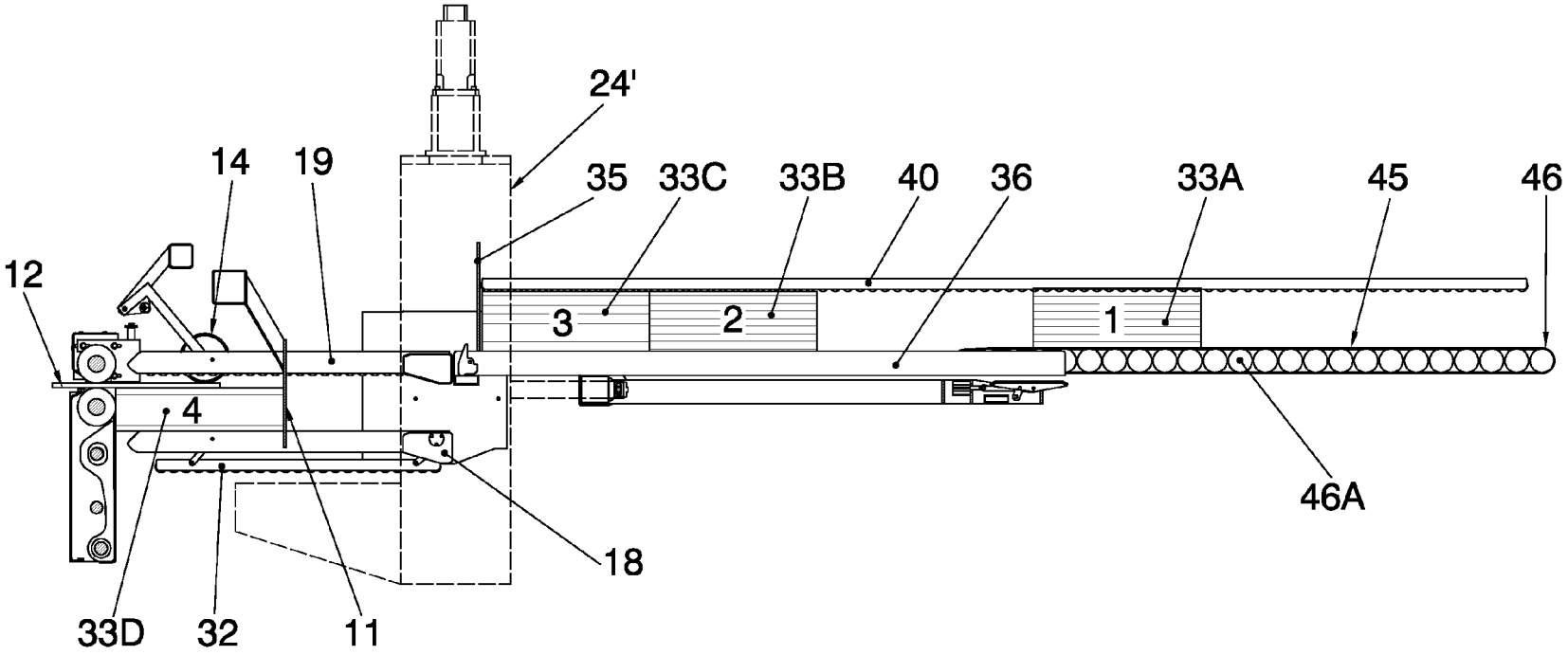
Figure 22:
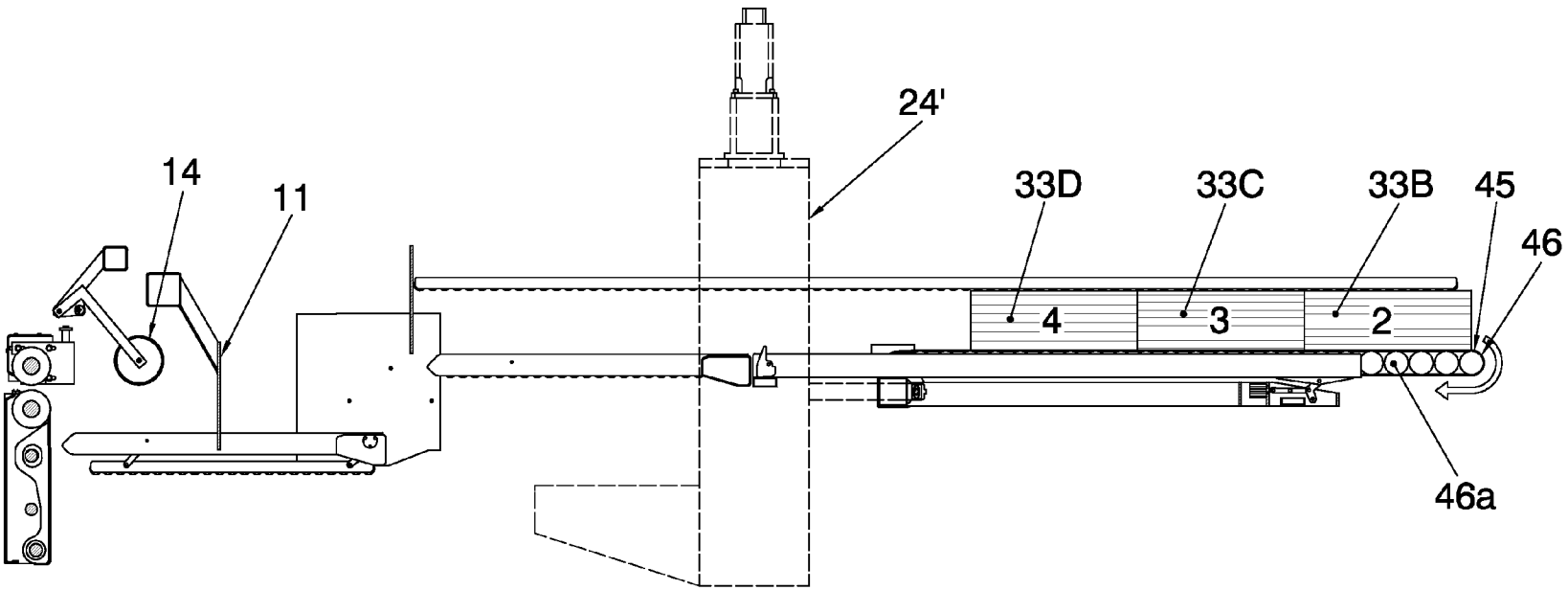
FIGS. 22 to 24 show three steps of an embodiment for the extraction of the finished bundles from the stacking machine.

In accordance with what has previously been indicated, FIGS. 7 to 19 show an example of the operation of the machine illustrated in FIGS. 1 to 4 in a work cycle which comprises 15 steps for forming four bundles or cardboard sheets, while FIGS. 20 to 22 show three steps of an embodiment for the extraction of the finished bundles from the stacking machine.

Figure 7:
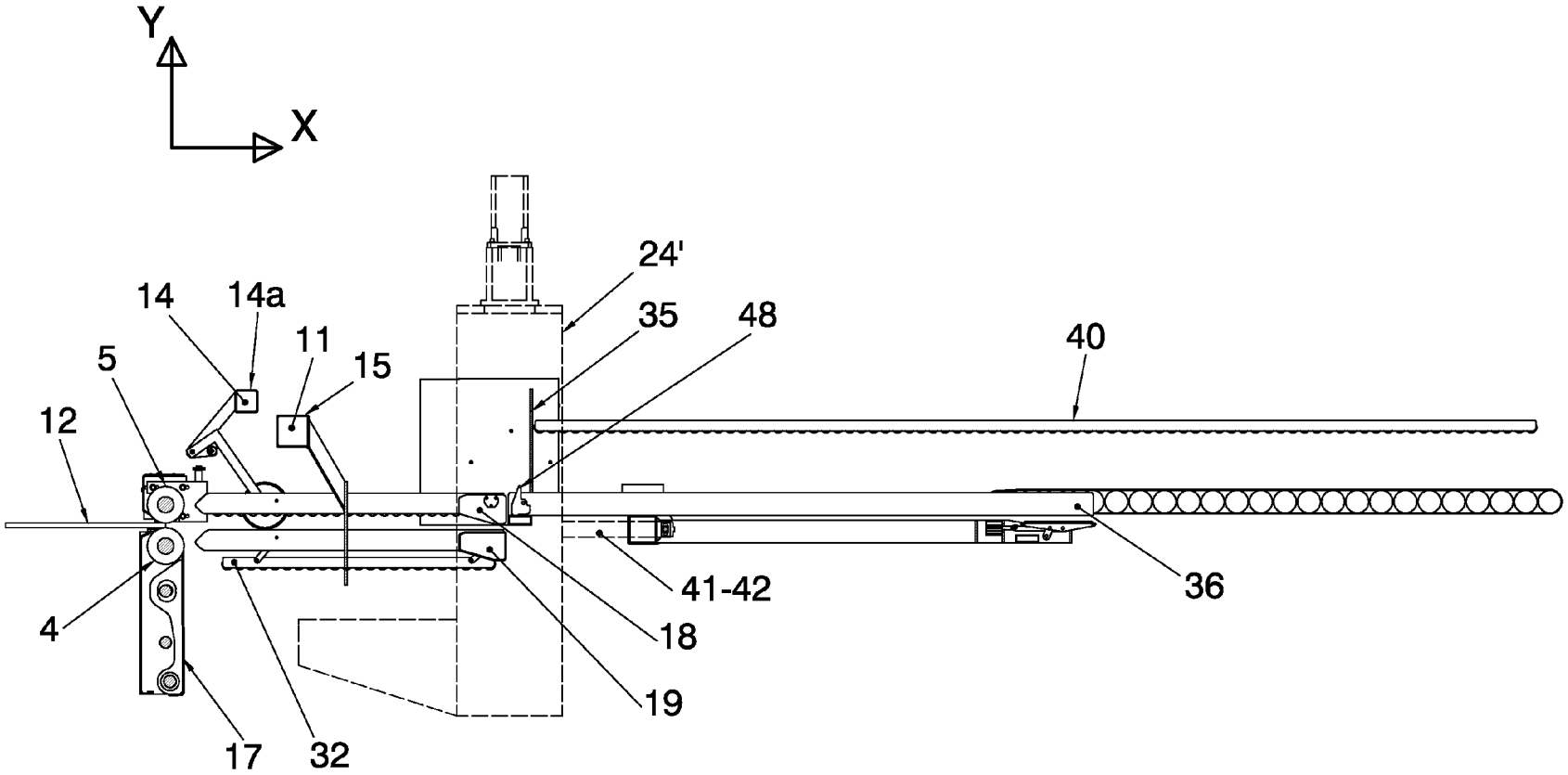
FIGS. 7 to 21 show an embodiment of the operation of the machine illustrated in FIGS. 1 to 6 in a work cycle that comprises 15 steps for forming four bundles of cardboard sheets.

FIG. 7 illustrates the stacking machine in the first step of the mentioned work cycle, in which it is completely empty and is in the rest state, i.e., it is in its zero starting point. In can be seen how the second stacking table -19- is in standby to receive boxes -12- to begin with the stacking, and the first stacking table -18- is in the standby position to carry out the separation of bundles. To that end, the right carriage -24'- moves by means of the displacement screw -27'- to the desired position. The front stop -11-, the infeed pressure roller -14- and the discharge presser -40- are adjusted according to the type/size of the box and bundle height. The upper infeed shaft -5- is also in a position adjusted to the thickness of the box. This thickness is controlled by means of the cam -8- which in turn is driven by means of the motor -9-. In that instant the mobile evacuation table -36- is fastened to the right carriage -24'- (drawn with a dotted line) by action of the locking cylinder -41- which locks the locking arm -42- to the right carriage -24'-. The second stacking table -19- is arranged, according to what has previously been mentioned, with rows of retractable pressure wheels -32- which are retracted when the second table -19- has surpassed level -0- of receiving boxes -12-.

Figure 8:
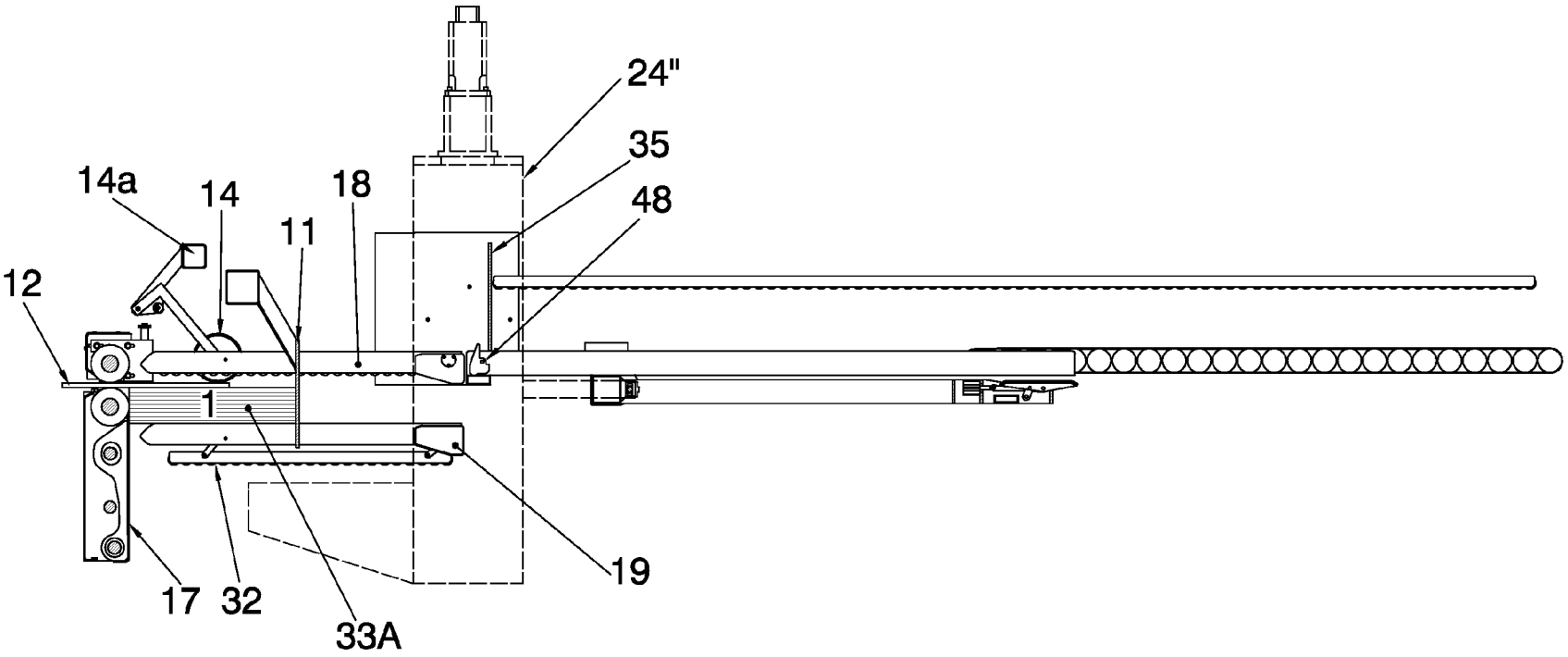

In the second work step shown in FIG. 8, the second stacking table -19- has begun to receive boxes -12- which it will continue receiving until completing the size of the first bundle -33A- which has been programmed. To that end, the second stacking table -19- gradually recovers the vertical position continually without stopping, according to the arrival speed of the boxes -12-. The swinging beater -17- squares up the bundle -33A- against the front stop -11- and the infeed pressure wheel -14- acts non-stop.

Figure 9:
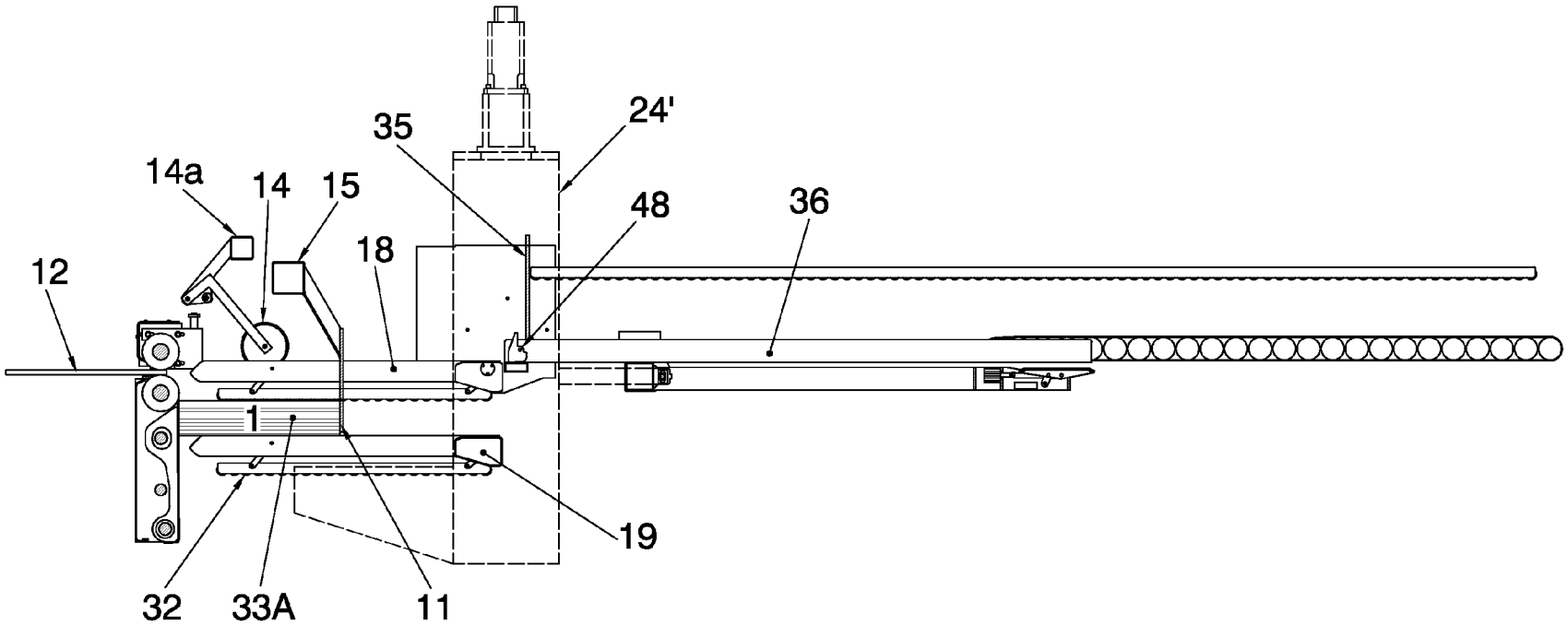

In the third step shown in FIG. 9, the formation of the first bundle -33A- on top of the second stacking table -19- with the desired number of boxes has been finished, therefore the first stacking table -18- enters into action and separates bundles, performing a very fast vertical movement and being inserted between the last box of the first bundle -33A- and the incoming box -12- which will form the first box of the second bundle. When the first stacking table -18- surpasses level zero, its rows of pressure wheels -32-, until now retracted, extend to perform their function of applying pressure on the first bundle -33A- therebelow.

Figure 10:
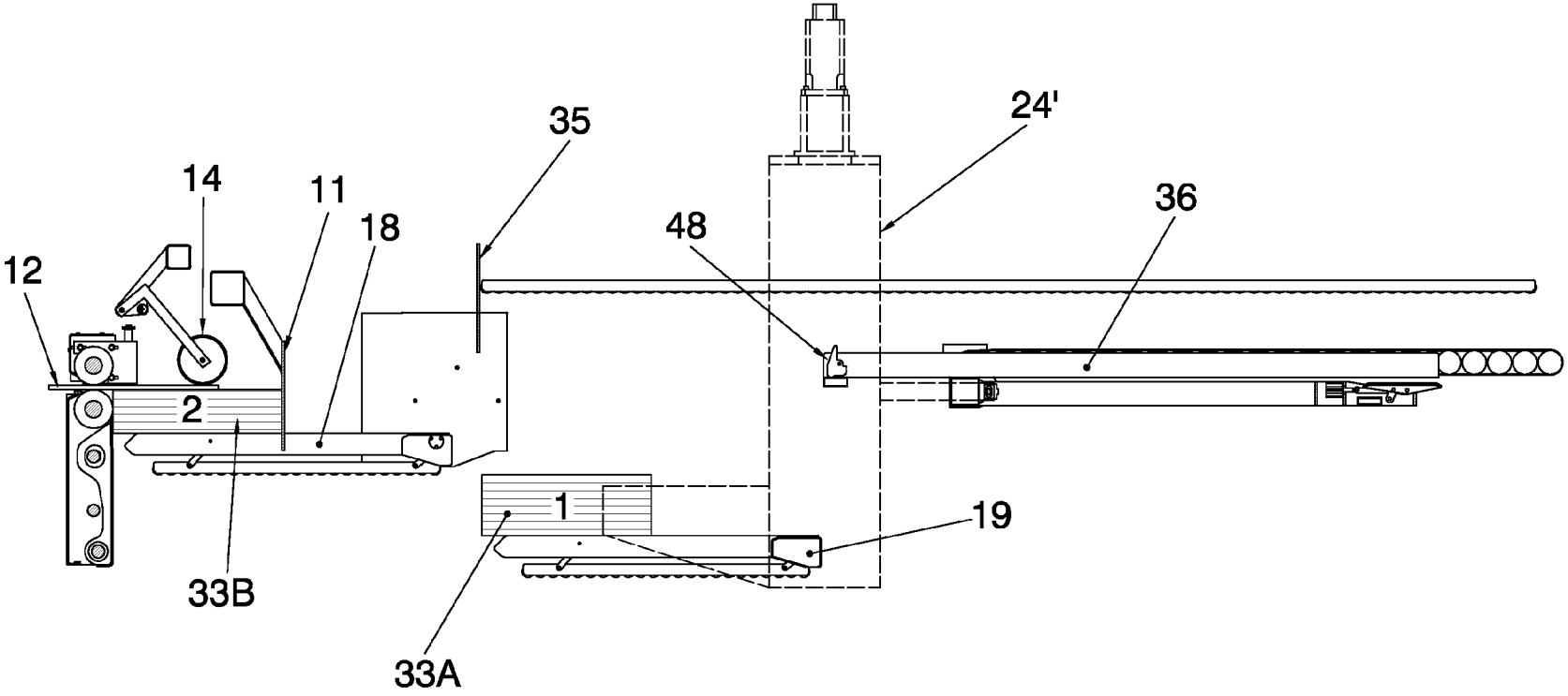

In the fourth step shown in FIG. 10, the first stacking table -18- is receiving boxes -12- and forming the second bundle -33B- by means of the same elements and movements which are described in relation to the second step with respect to the first bundle -33A-. Simultaneously, the second stacking table -19- has to remove the already created first bundle -33A-. To that end the right carriage -24'- moves in the longitudinal plane -X- carrying with it the second stacking table -19- looking for the unloading position. The mobile evacuation table -36- follows this movement as it is still fastened thereto.

Figure 11:
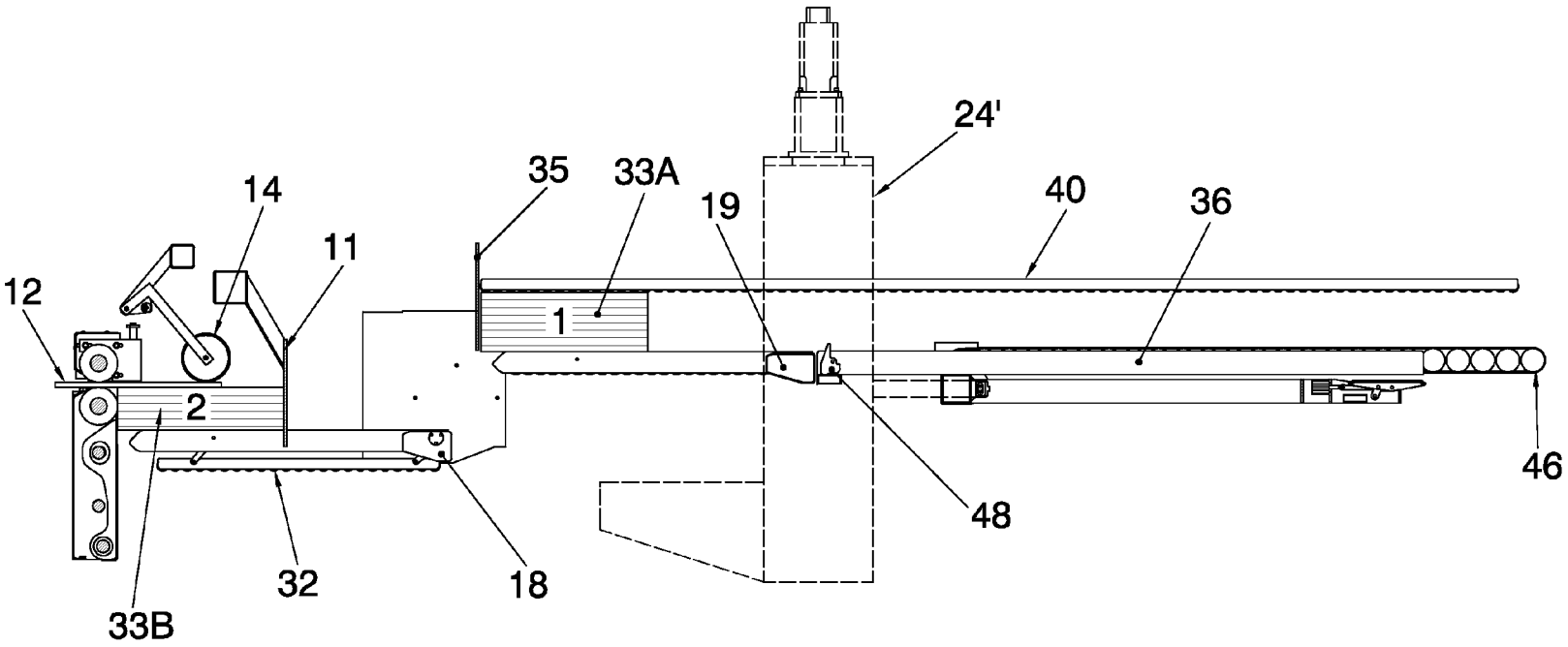

In the fifth step shown in FIG. 11, boxes -12- continue to be stacked to form the second bundle -33B-, while the second stacking table -19- has already reached its unloading position. As can be seen, since the second stacking table -19- has already upwardly surpassed level "0" of the incoming boxes -12-, the rows of pressure rollers -32- of the second stacking table -19- are retracted and are concealed within the arms of the second stacking table -19-. The discharge presser -40- also begins its operation on the first bundle -33A-.

Figure 12:
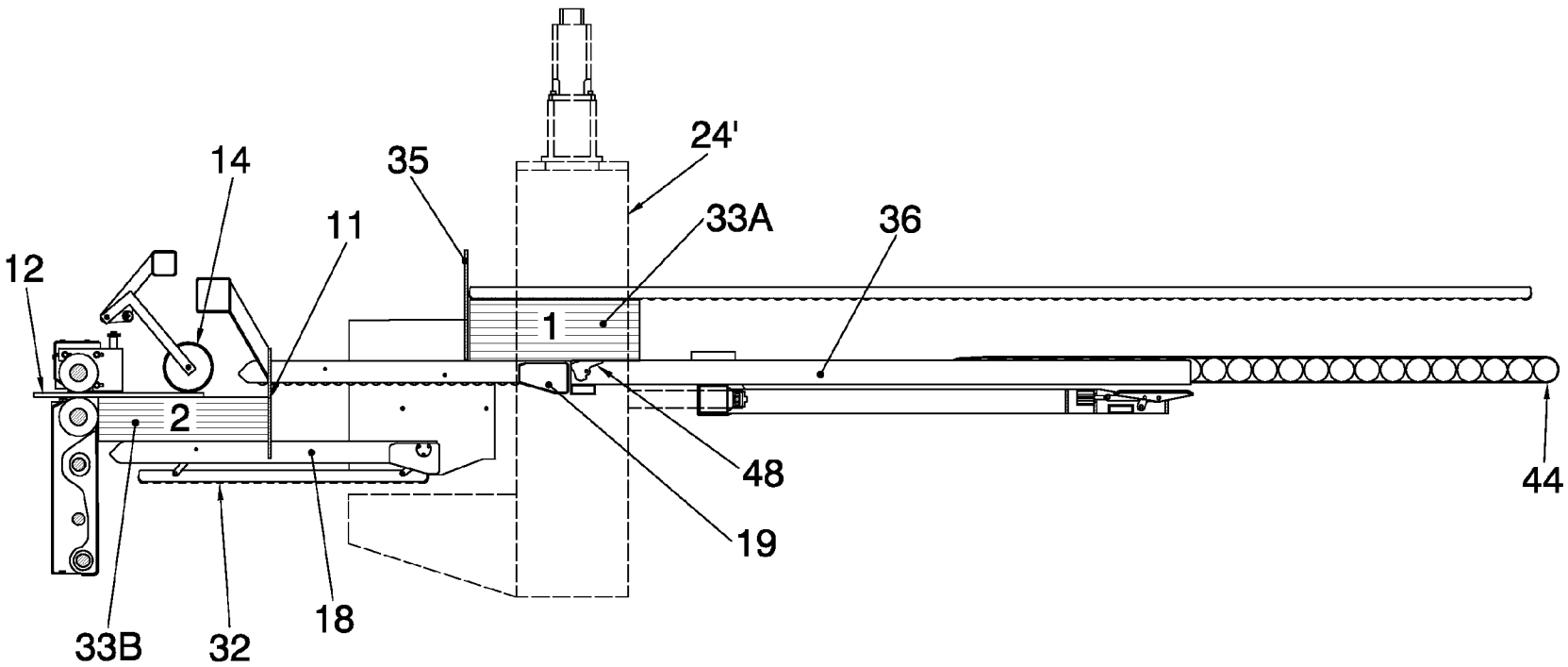

In the sixth step shown in FIG. 12, the second bundle -33B- continues in the stacking process, while the second stacking table -19- moves back in a direction towards the standby point in which it will occupy the position which the first stacking table -18- occupied until the third step. In that backwards movement, the first bundle -33A- is brought to contact against the unloading stop -35- thus achieving that the first bundle -33A- passes from the second stacking table -19- to the mobile unloading table -36- which, in that moment, continues to be fastened to the right carriage -24'- and, therefore, is displaced together with the second stacking table -19-. The actuation of the retractable unloading stop -48- will prevent the first bundle -33A- from going backwards when it has just completely changed its position.

Figure 13:
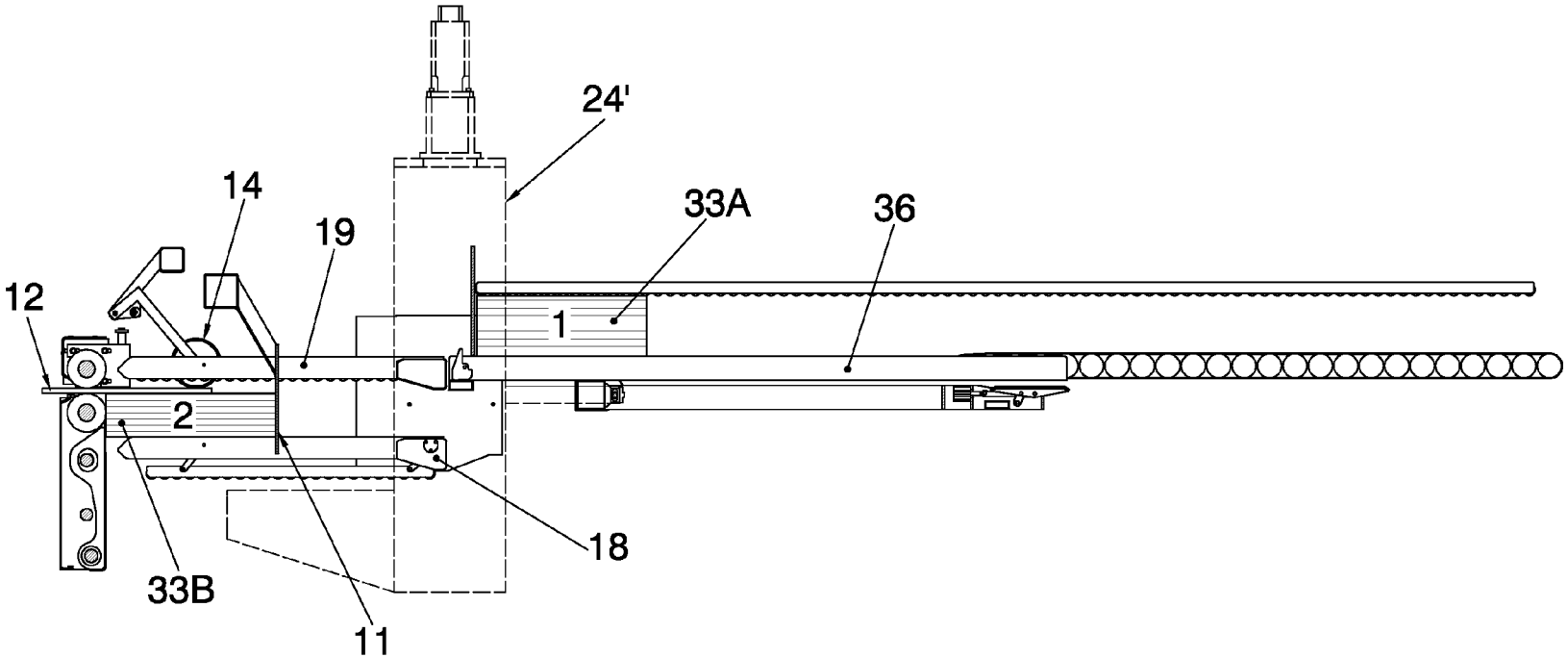

In the seventh step shown in FIG. 13, the second stacking table -19- has reached the standby position and the first bundle -33A- is completely placed on top of the mobile unloading table -36-.

The fourth, fifth, sixth and seventh steps previously described have to be performed in a time period shorter than what it would take to stack the second bundle -33B- because otherwise, the second stacking table -19- would not reach the standby position analogous to the standby position of the first stacking table -18- in the third step shown in FIG. 9 on time.

Figure 14:
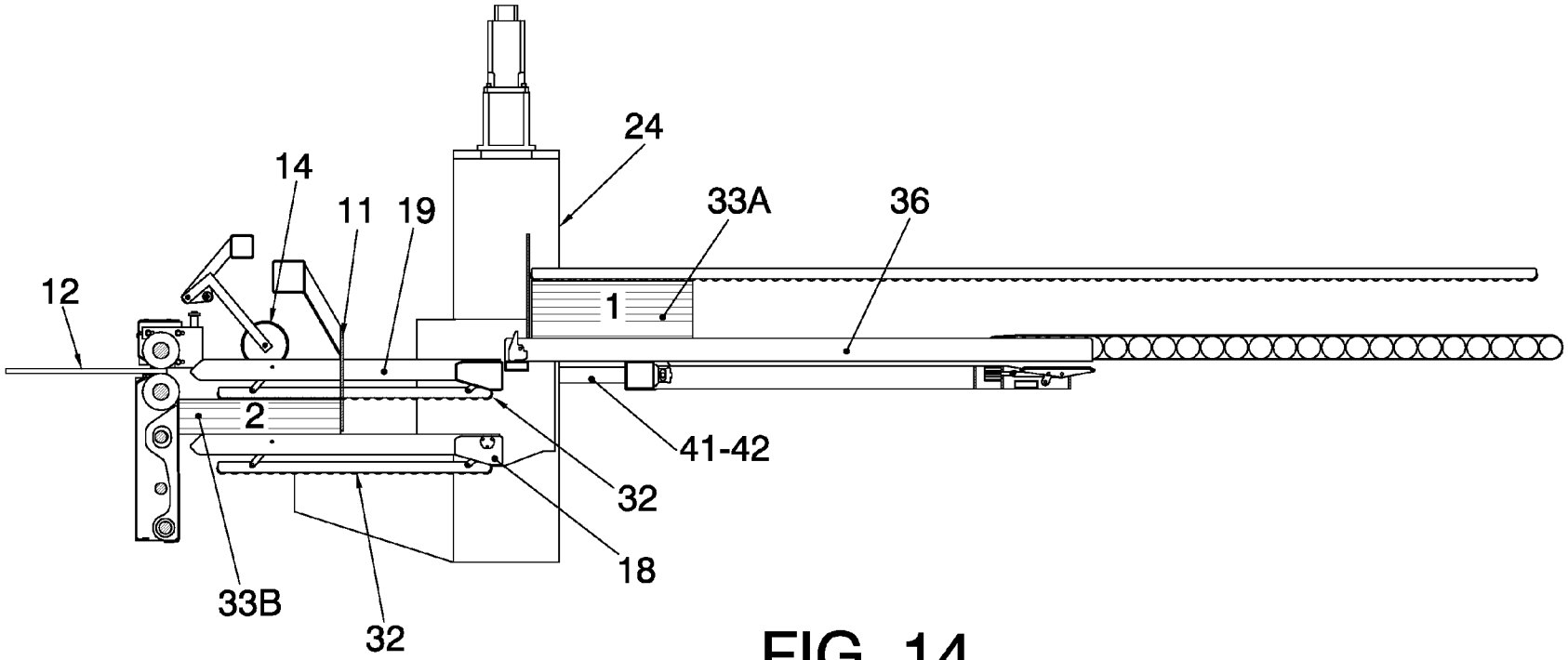

According to FIG. 14, in the eighth step the second bundle -33B- has been finished and, as such, the second stacking table -19- enters into action to separate the second bundle -33B-. According to what has been previously discussed with respect to the separation of the first bundle -33A- due to the action of the first stacking table -18-, once level zero is surpassed, the pressure wheels -32- retracted in the arms of the second stacking table -19- are deployed. Just in that instant the mobile unloading table -36- is fastened to the left carriage -24- (drawn with continuous line) by means of the locking arm -42- driven by the locking cylinder -41-. The left carriage -24- moves the first stacking table -18- which has the second already completed bundle which should be removed. The first bundle -33A- continues to be able to circulate on top of the mobile evacuation table -36-, depending on its size.

Figure 15:
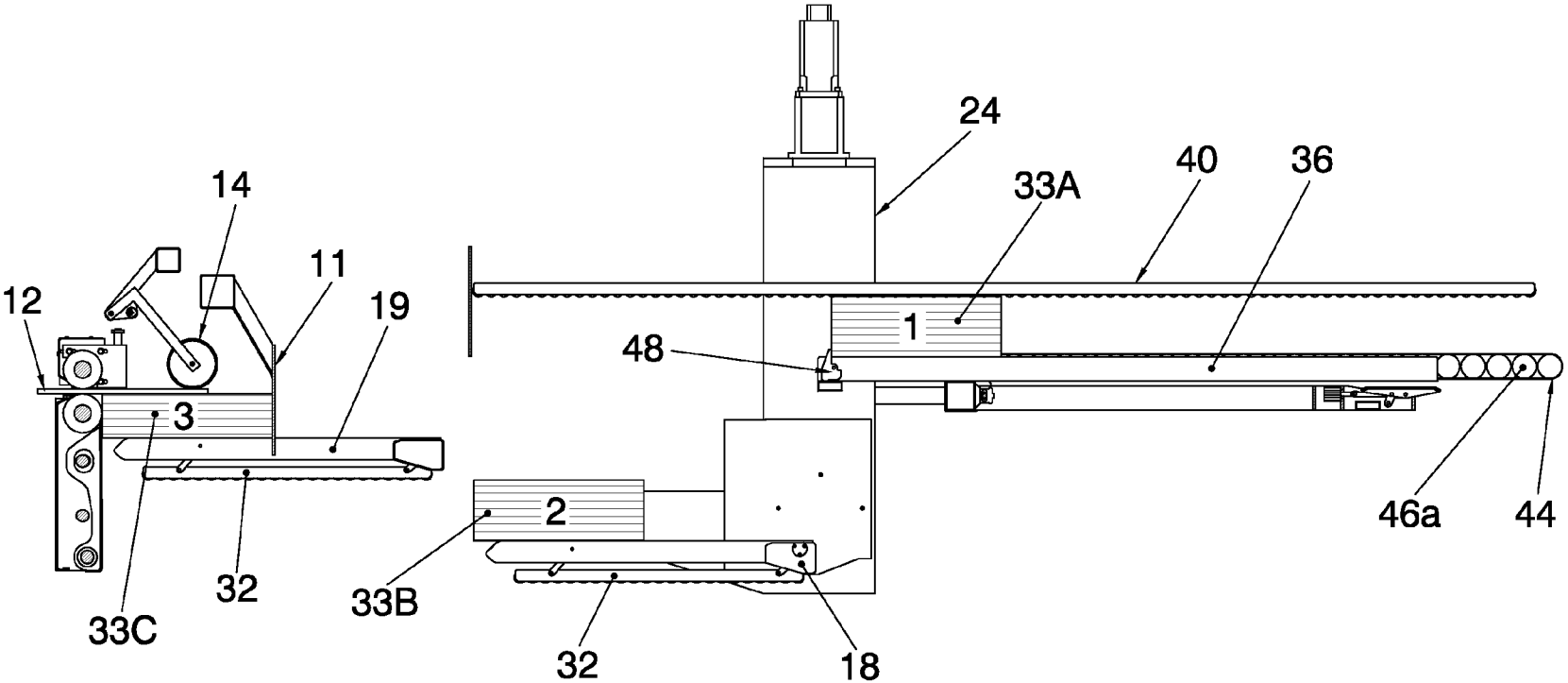

In the ninth step shown in FIG. 15, the third bundle -33C- is being stacked. The left carriage -24- (drawn with a continuous line) is making the mobile unloading table -36-advance while the first stacking table -18- which has the second bundle -33B- moves towards the unloading position to remove the second bundle -33B-. The first bundle -33A- moves on top of the mobile unloading table -36- without being able to go backwards due to the effect of the retractable unloading stop -48-. The mobile unloading table -36- is partially or totally introduced within longitudinal cavities of the fixed table -46-, thus achieving that the first bundle -33A- is installed in this new position.

Figure 16:
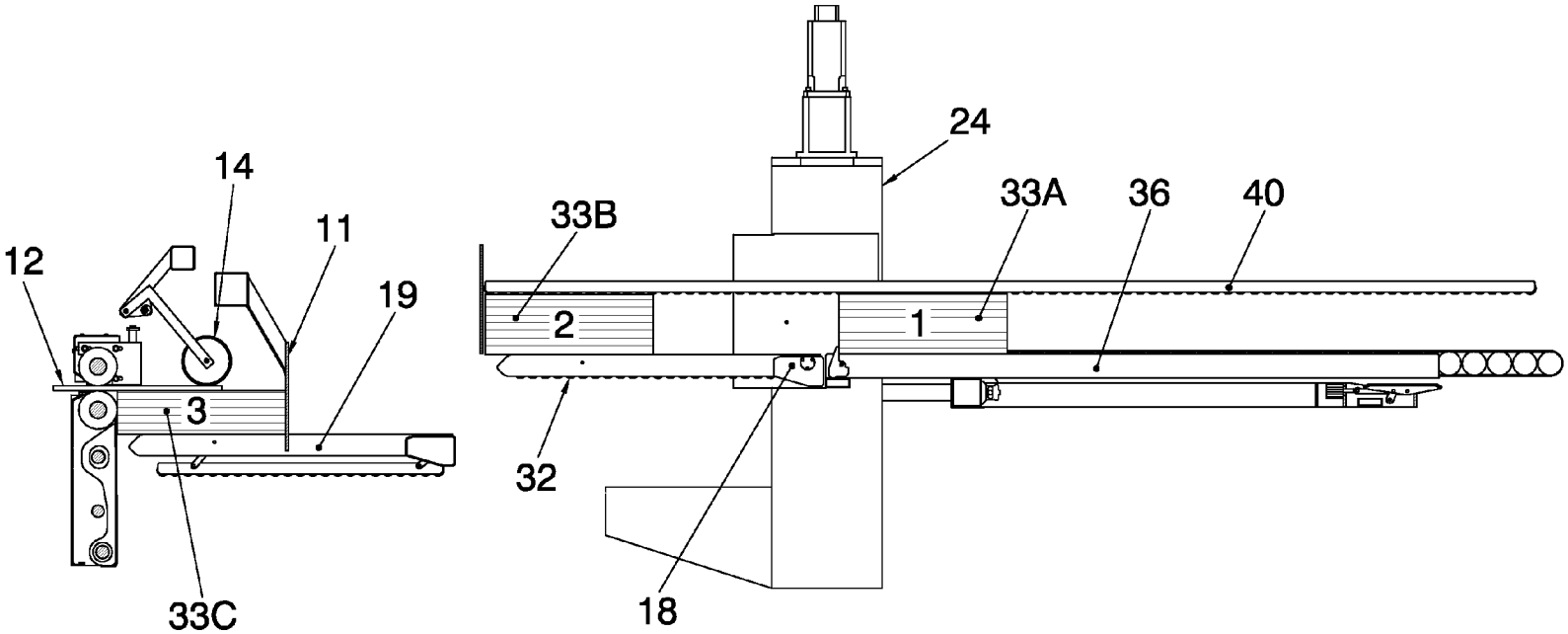

In the tenth step shown in FIG. 16, the rows of pressure wheels -32- of the left displacement table -18- have been retracted to surpass level -0- of receiving the boxes -12-. Likewise, the first stacking table -18- is arranged to deposit the second bundle -33B- on top of the mobile evacuation table -36-. Now, the second bundle -33B- is also pressed by the discharge presser -40-.

Figure 17:
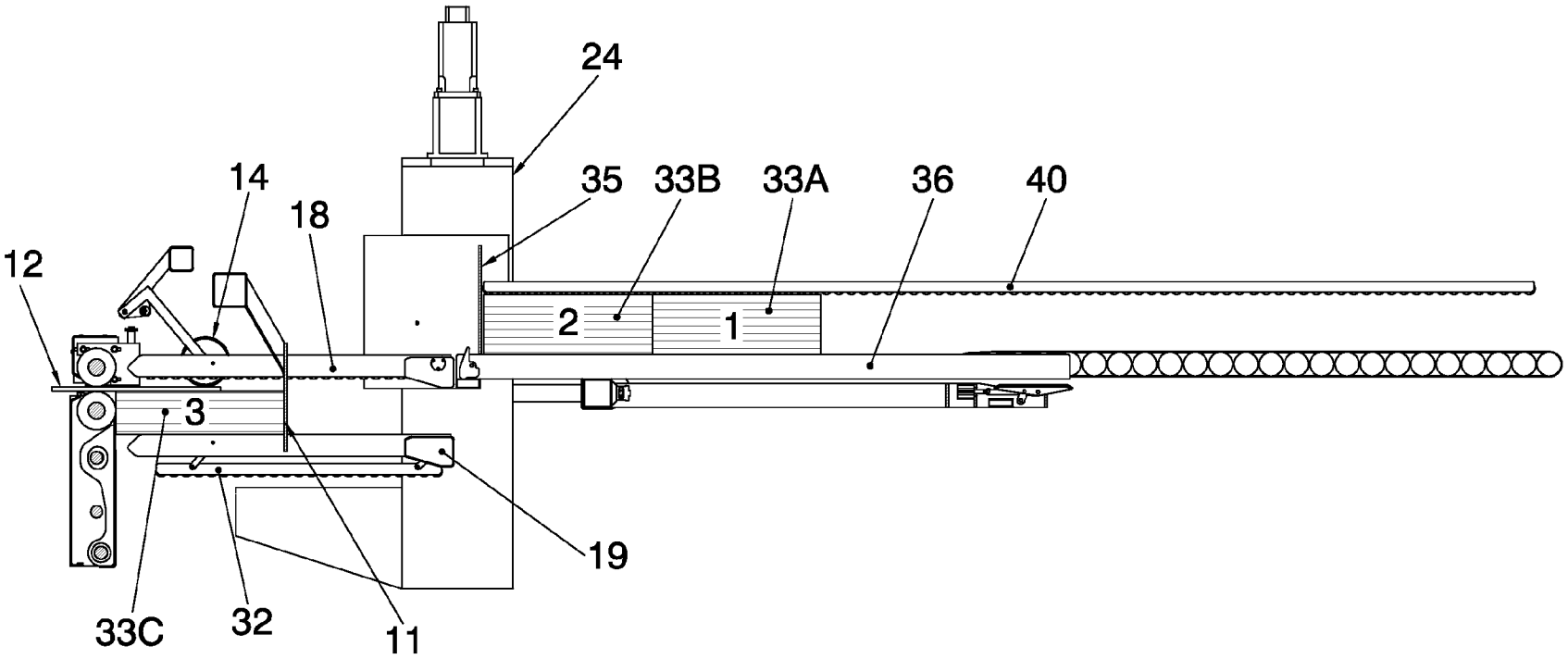

In the eleventh step shown in FIG. 17, when the first stacking table -18- moves back to again occupy the standby position previously described in relation to the first, second and third steps, it has pushed the second bundle -33B- against the unloading stop -35- to transfer the second bundle -33B- to the mobile unloading table -36- contacting the first bundle -33A-. The first bundle -33A- and the second bundle -33B- continue to be pressed by the discharge presser -40- which therefore compacts the bundles -33A, 33B-, facilitating the gluing of the flaps of the boxes -12- in these bundles.

Figure 18:
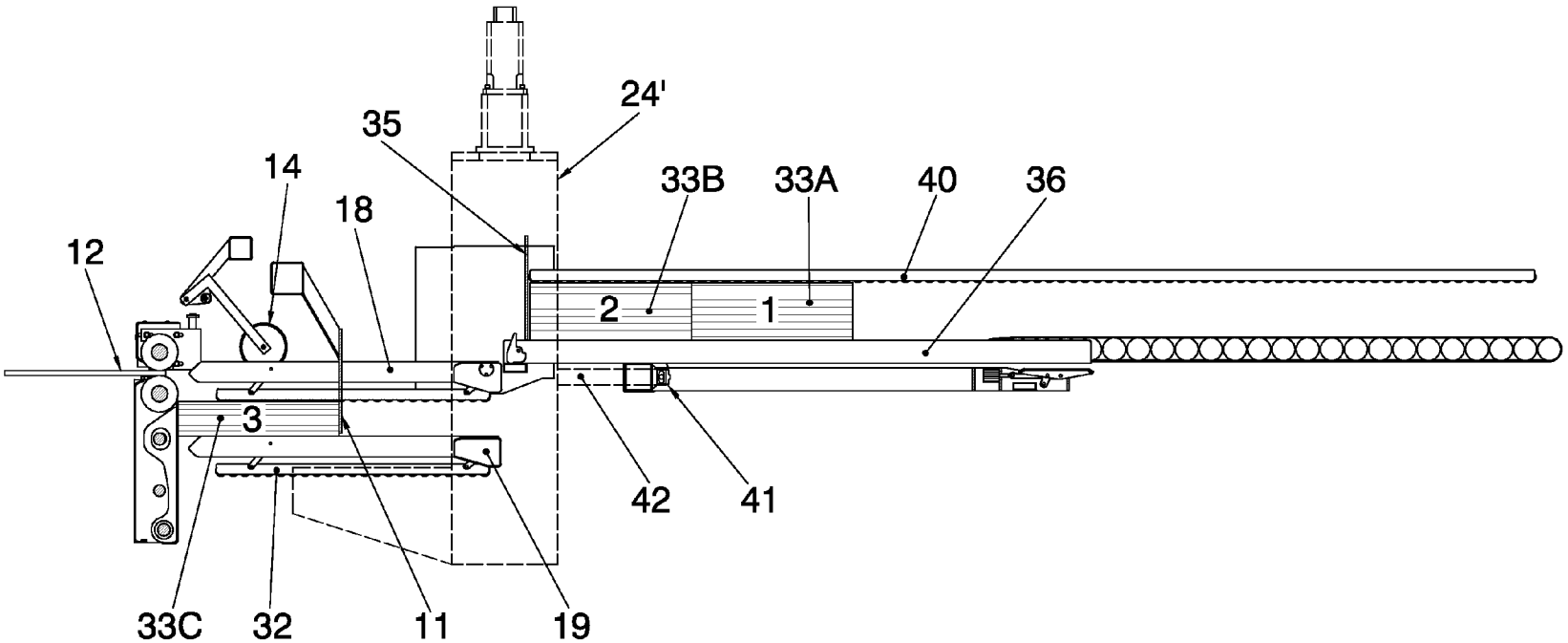

FIG. 18 relates to the twelfth step, the first bundle -33A- and the second bundle -33B- are arranged on the mobile unloading table -36-. The third bundle -33C- has in turn been completed and the first stacking table -18- has again rapidly descended, being inserted between the last box of the third bundle -33C- stacked on the second stacking table -19- and the following box -12- coming from the prior module of the production line, thus serving as the base for stacking a fourth bundle. In turn, just in that moment the mobile unloading table -36- engages the right carriage -24'- to remove the third bundle -33C-. The first stacking table -18- is arranged to receive the following box -12- in its arms and the rows of pressure wheels -32- emerge such that they press the third bundle -33C-. In turn, the infeed pressure wheels -14- are no longer acting.

In the thirteenth step illustrated in FIG. 19, while the fourth bundle -33D- is being formed on the first stacking table -18-, while the second stacking table -19- has advanced due to the action of the right carriage to the position from which it will rise to pass the third bundle -33C- in the mobile unloading table -36-. In turn, the first bundle -33A- and the second bundle -33B- pass from the mobile unloading table -36- which has been introduced into the cavities of the fixed table -46- to the worktop of the fixed table -46-. Depending on its size, the first bundle -33A- and the second bundle -33B- seek the discharge end of the stacking machine towards the following work module. The bundles -33A, 33B- continue to be pressed by the discharge presser -40-. It is advisable to maintain this pressure while the size of the bundle with regard to its size so allows, i.e., it is advisable that the different bundles do not leave as it can be the area in which they are pressed from above and below, in order to ensure the reasonable time necessary so that the drying of the gluing line of the boxes -12- in the completed bundles extends as much as possible.

In the fourteenth step illustrated in FIG. 20, the first bundle -33A- has passed to the fixed table -46-, such that the idler wheels -46*a*- allow it to be easily displaced on top of said fixed table -46-. The second stacking table -19- moves backwards towards the standby position already discussed in relation to the first, second and third steps and leaves the third bundle -33C- on the mobile unloading table -36-, such that the third bundle -33C- pushes the second bundle -33B- towards the discharge end of the stacking machine. Meanwhile, the fourth bundle -33D- of boxes -12- is being formed on the first stacking table -18-, the infeed pressure wheels -14- acting according to that which has been explained above in relation to the formation of the previous bundles -33*a*, 33B, 33C-.

In the fifteenth step illustrated in FIG. 21, the second stacking table -19- has reached the standby position already discussed above in relation to the first, second and third steps, to wait to separate the fourth bundle -33D- once it has been completed. This position is analogous to that shown in FIG. 13 in relation to the seventh step referring to the formation of the second bundle -33B- and the passage of the first bundle -33A- to the mobile unloading table -36-, such that for the formation, separation and unloading of the fourth bundle -33D- and of the successive bundles, the stacking machine will act analogously to that which has been described above in relation to steps eight to fifteenth in as many repeated cycles as necessary to form the number of desired bundles. In this process, the new bundles deposited on the mobile unloading table -36- successively push the previously formed bundles which are located on the mobile table -36- and on the fixed table -46- towards the discharge end of the stacking machine.

Once the desired number of bundles has been formed, or in the event that the stacking machine must be cleared for some reason, for example to check the first bundle, an unforeseen jam situation is presented, or in the event of extracting the last bundles formed, i.e., when the push exerted by successive new bundles can no longer be used, the stacking machine carries out the final steps which are explained below assuming, by way of example, that the fourth bundle -33D- completes the desired number of bundles.

In the first final step, the first bundle -33A- has been cleared from the stacking machine by the push exerted by the fourth bundle -33D- pushing the third bundle -33C- and the second bundle -33B-.

Figure 23:
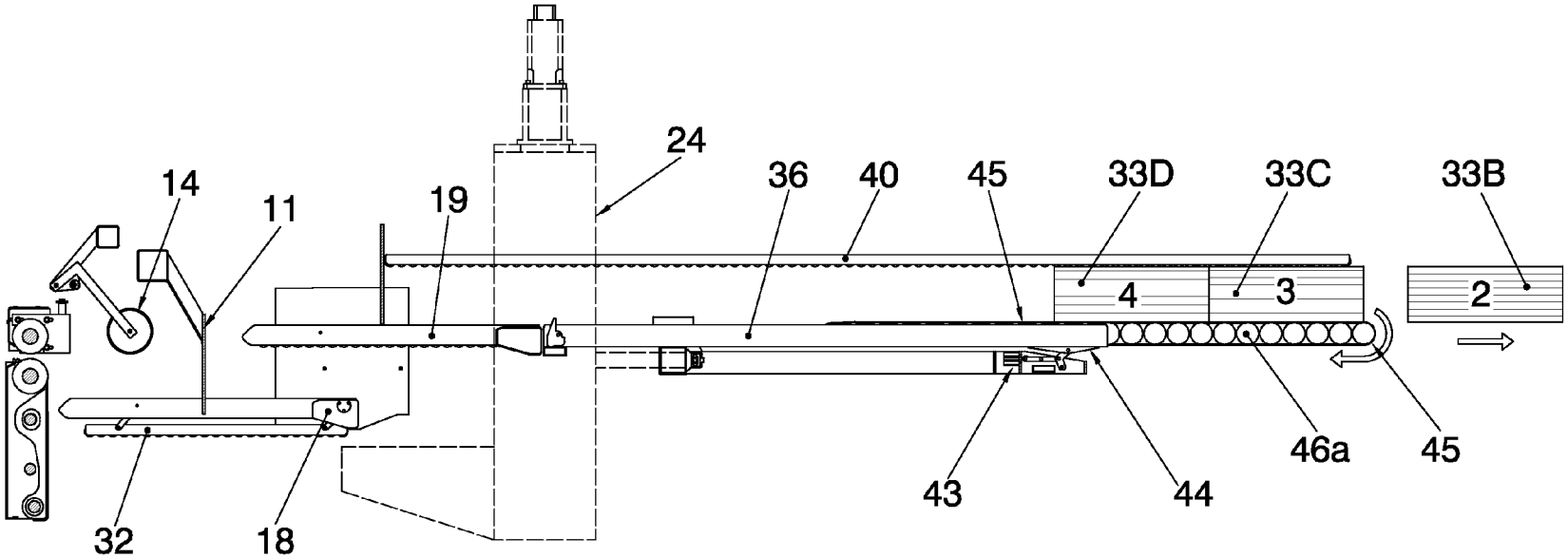
Figure 24:
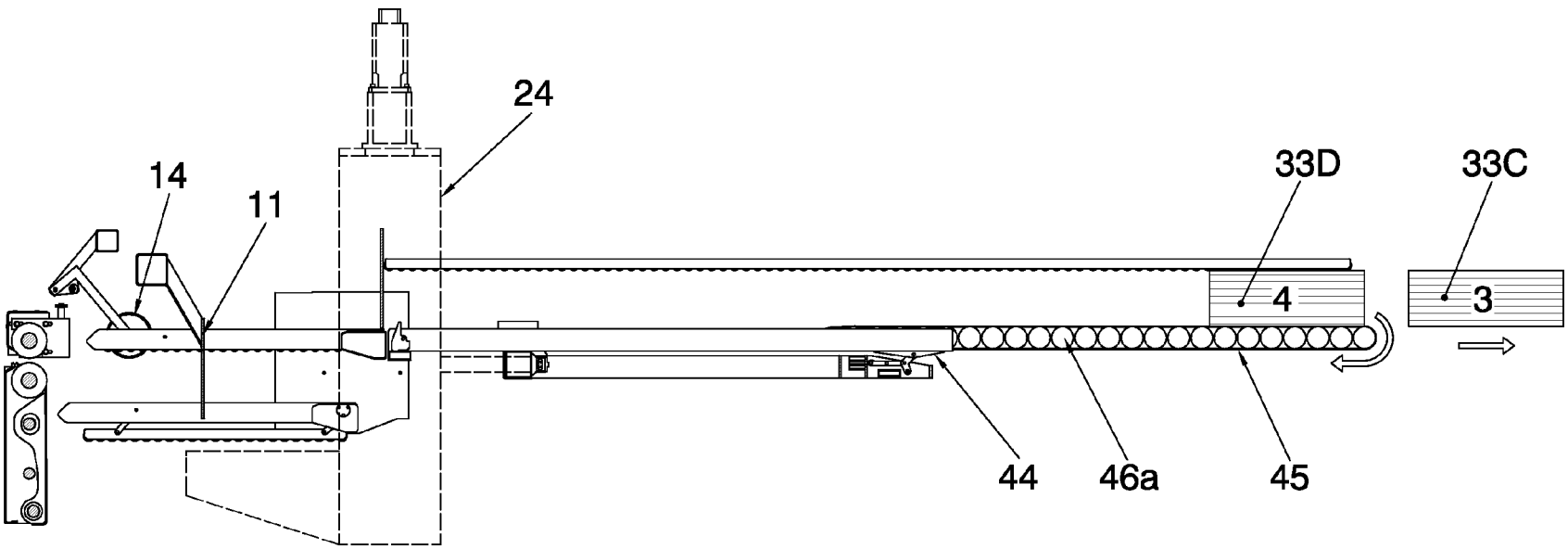

In accordance with FIG. 23, new bundles are no longer formed in the second final step; therefore it is not possible to clear the bundles already formed -33B-, 33C, 33D- by natural push. According to that which has been indicated above, due to the action of the right displacement carriage -24'- the second stacking table -19- (identical to the first stacking table -18- driven by the left carriage -24-) has the capacity to move in the longitudinal plane -X- and in the vertical plane -Y-. On the other hand, according to the embodiment of the final steps shown in FIGS. 22 to 24, the unloading table -36- is engaged with the right carriage -24'-. In turn, a driving pin of the unloading belt -45- is provided in the sector which the mobile unloading table -36- has to cover, driven by the unloading pneumatic cylinder -43- and longitudinally mounted in the center of the fixed table -46- such that the unloading belt -45- can rotate when the pin -44- arranged against the belt -45- is operated. In this position, i.e., when the pin -44- is against the belt -45-, in the event that the right carriage -24'- moves longitudinally in the -X- plane, the belt -45- rotates with controlled movement such that the bundles -33B, 33C, 33D- are cleared one by one. Thus, by unloading the second bundle -33B-, the third bundle -33C- and the fourth bundle -33D- advance towards the discharge end of the stacking machine. The purpose of clearing the bundles -33B, 33C, 33D- one by one is so as to not endanger the bundles which have already entered the following module of the production line and to not cause jams or flaws in the boxes.

In the third final step, to the pin -44- is given more ground to cover such that it causes a movement of the belt -45- which clears the third bundle -33C- from the fixed table -46-. Then, the pin -44- covering more ground, the corresponding movement of the belt -45- clears the fourth bundle -33D-. The pin -44- only acts when the program loaded in the central controller automatically indicates for the stacking machine to do so.

The invention claimed is:

1. Stacking machine for stacking flat items comprising:

an infeed end for flat items;

a discharge end for bundles of flat items;

stacking means in which flat items successively received from the infeed end are stacked to form successive bundles from stacks of stacked flat items, wherein the stacking means further comprises:

a first stacking table and a second stacking table arranged in respective horizontal planes vertically parallel to one another;

first displacement means susceptible to displacing the first stacking table in a longitudinal plane and in a vertical plane at least between a stacking position in which the first stacking table receives flat items to successively form first bundles and an unloading position in which the bundles are successively transferred from the first stacking table to unloading means;

second displacement means susceptible to displacing the second stacking table in said longitudinal plane and in said vertical plane at least between said stacking position in which the second stacking table receives flat items to successively form second bundles when the first stacking table is not in said stacking position, and said unloading position in which the bundles are successively transferred from the second stacking table to said unloading means;

coupling means to alternatively couple the first stacking table and the second stacking table to the unloading means for collecting successive bundles coming from the stacking tables when said stacking tables are in the stacking position with the already finished bundle and which automatically decouple when the stacking tables are in the standby position; and wherein the first and second displacement means respectively comprise:

vertical displacement means for lowering the stacking table with which they are associated from a standby position located above the box infeed end position or level 0, to the initial stacking position, to then lower the stacking table continually and proportionally to the growth of the stack caused by each new flat item deposited on the stack to a final stacking position, and to again raise the stacking table from a longitudinally advanced position located below the unloading position, to the vertical level necessary for carrying out the unloading;

longitudinal displacement means for advancing the stacking table with which they are associated horizontally from the stacking position towards the advanced position located below said unloading position and to make the stacking table move back from the unloading position towards the standby position;

wherein the unloading means comprise a mobile unloading table longitudinally guided by respective side guiding elements and displaceable between an extended position towards the infeed end and an advanced position towards the discharge end of the machine.

2. Stacking table according to claim 1, wherein the coupling means couple the mobile unloading table to one of the stacking tables when the latter is in said unloading position until it is in said standby position while the other stacking table is in said stacking position.

3. Stacking machine according to claim 2, further comprising:

a transverse vertical unloading stop arranged in the rear part of the mobile unloading table such that when one of the stacking tables has moved up to its unloading position, it contacts the rear part of the bundle present in the corresponding stacking table and retains the bundles which is unloaded on the mobile unloading table when this stacking table passes from said unloading position to said standby position and the mobile unloading table passes from its retracted position to its extended position;

a retractable unloading stop arranged in the rear part of the mobile unloading table which retracts when, upon moving towards its extended position, the mobile unloading table slides below the bundle retained by the vertical unloading stop, and which emerges upwards from the mobile unloading table when the latter returns to its retracted position, such that it drags the bundle towards the fixed evacuation table.

4. Stacking machine according to claim 2, further comprising a discharge presser which extends longitudinally on top of the mobile unloading table from the unloading stop towards the table on top of a fixed evacuation table, the discharge presser being height-adjustable to exert pressure on at least the bundles which are located on the mobile unloading table.

5. Stacking machine according to claim 2, wherein the mobile unloading table comprises longitudinal arms and the fixed evacuation table comprises longitudinal cavities in which said longitudinal arms are inserted when the mobile unloading table is displaced to its retracted position.

6. Stacking machine according to claim 1, wherein the first and second displacement means comprise a longitudinal displacement carriage displaceable along the horizontal guiding means due to the action of a longitudinal displacement screw connected to a longitudinal displacement motor.

7. Stacking machine according to claim 6, wherein the vertical displacement means are arranged in the longitudinal displacement carriage and comprise vertical guiding means which guide the stacking table to which they are vertically connected, and a vertical displacement screw driven by a motor coupled to the stacking table to displace it vertically.

8. Stacking machine according to claim 7, wherein the vertical guiding means comprise a first vertical guide and a second vertical guide between which the vertical displacement screw is arranged.

9. Stacking machine according to claim 1, wherein the infeed end comprises a transversely rotating lower infeed roller and upper infeed roller, between which the flat items enter with pressure applied on their upper face by the upper infeed roller and on their lower face by the lower infeed roller;

at least one of the infeed rollers is connected to a drive motor.

10. Stacking machine according to claim 9, further comprising a swinging infeed beater mounted on an eccentric shaft and a front stop which are transversally arranged and between which the stack of flat items is formed;

the infeed beater squares up the incoming flat items that are going to be stacked;

the lower infeed roller, the upper infeed roller and the eccentric shaft are connected to the drive motor by means of an infeed transmission belt.

11. Stacking machine according to claim 10, wherein the upper infeed roller is height-adjustable to distance itself from or move closer to the lower infeed roller depending on the thickness of the flat items which enter between the infeed rollers and on the pressure to be applied by the infeed rollers on the faces of the flat items.

12. Stacking machine according to claim 11, wherein the upper infeed roller is connected to a thickness adjustment cam which regulates the height of the upper infeed roller;

the movements of the thickness adjustment cam are controlled and driven by a control motor.

13. Stacking machine according to claim 10, wherein the front stop is mounted in a transverse frame longitudinally moveable on adjustment screws driven by a drive motor for adjusting the distance of the front stop with respect to the infeed beater.

14. Stacking machine according to claim 1, further comprising a plurality of rotating infeed pressure wheels mounted in a transverse auxiliary frame which apply pressure on the upper faces of the successive flat items deposited on top of the stack of flat items.

15. Stacking machine according to claim 14, wherein the infeed pressure wheels are adjustable with regard to the pressure which they exert on the upper faces of the flat items.

16. Stacking machine according to claim 1, wherein each stacking table comprises a plurality of longitudinal, horizontal arms in which respective rows of retractable pressure wheels are arranged which are retracted in the longitudinal arms when the stacking table is in said standby position and emerging in the lower portion of the longitudinal arms when the stacking table reaches its initial stacking position on top of the other stacking table which is in said final stacking position, thus exerting pressure on the stack of flat items which is on the other stacking table.

17. Stacking machine according to claim 1, further comprising a fixed evacuation table comprising a plurality of longitudinal rows of idler wheels on which the bundles can roll towards the discharge end of the stacking machine.

18. Stacking machine according to claim 17, wherein the fixed evacuation table comprises a central longitudinal unloading belt which passes along the upper surface of the fixed evacuation table and which is connected to driving means for transporting bundles received from the mobile unloading table towards the discharge end of the stacking machine.

19. Stacking machine according to claim 18, wherein the unloading belt encircles a longitudinal row of rotating rollers;

the driving means of the unloading belt are connected in the lower portion to the front part of the mobile unloading table and comprise a driving pin displaceable by a pneumatic driving cylinder between a retracted position in which it does not contact the lower part of the unloading belt and a raised position in which it contacts said lower part and pulls it towards the infeed end of the stacking machine when the mobile unloading table is displaced in that direction, such that the upper part of the unloading belt transports the bundles received towards the discharge end of the stacking machine.

* * * * *